US008686650B2

(12) United States Patent
Shimura

(10) Patent No.: US 8,686,650 B2
(45) Date of Patent: Apr. 1, 2014

(54) LED BACKLIGHT DEVICE

(75) Inventor: Tatsuhisa Shimura, Yokohama (JP)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 149 days.

(21) Appl. No.: 13/291,720

(22) Filed: Nov. 8, 2011

(65) Prior Publication Data

US 2012/0112649 A1 May 10, 2012

(30) Foreign Application Priority Data

Nov. 9, 2010 (JP) ..... 2010-250716
Dec. 20, 2010 (JP) ..... 2010-282854
Oct. 14, 2011 (KR) ..... 10-2011-0105470

(51) Int. Cl.
*H05B 37/02* (2006.01)

(52) U.S. Cl.
USPC ..... 315/188; 315/185 R; 315/294

(58) Field of Classification Search
None
See application file for complete search history.

(56) References Cited

U.S. PATENT DOCUMENTS

2010/0060175 A1* 3/2010 Lethellier ..... 315/164
2010/0237799 A1* 9/2010 Choi et al. ..... 315/294
2011/0057960 A1 3/2011 Kim et al.
2011/0075057 A1* 3/2011 Kim et al. ..... 348/790

FOREIGN PATENT DOCUMENTS

JP 2006-319221 11/2006
JP 2007-069371 3/2007
JP 2007-208113 8/2007
JP 2009-054998 3/2009
KR 1020100128932 12/2010
KR 1020110057522 6/2011

* cited by examiner

*Primary Examiner* — Jany Richardson
(74) *Attorney, Agent, or Firm* — F. Chau & Associates, LLC

(57) ABSTRACT

An LED backlight device includes an inverter having an input connected to a DC power supply to provide an output AC current. A plurality of transformers are each configured to drop AC current input from the inverter. Input sides of the transformers are connected in series to an output of the inverter and output sides of the transformers are disposed in parallel. A plurality of full-wave rectification circuits are respectively connected to the output sides of the transformers and full-wave rectify the dropped AC currents, respectively. A plurality of smoothing circuits are respectively connected to outputs of the full-wave rectification circuits, and are configured to smooth the full-wave rectified currents to output DC currents, respectively. A plurality of LED strings are respectively connected to the outputs of the smoothing circuits and each of the LED strings have a plurality of LEDs.

18 Claims, 15 Drawing Sheets

LED BACKLIGHT DEVICE

CROSS-REFERENCE TO RELATED APPLICATIONS

This application claims under 35 U.S.C. §119 priority to and the benefit of Japanese Patent Application No. 2010-250716 filed Nov. 9, 2010, Japanese Patent Application No. 2010-282854 filed Dec. 20, 2010, and Korean Patent Application No. 10-2011-0105470 filed Oct. 14, 2011, the entire contents of which are incorporated by reference herein.

BACKGROUND

The present disclosure relates to an LED backlight device capable of turning on a plurality of light emitting diodes used as a light source of a liquid crystal display device.

Typically, liquid crystal display devices are lightweight, thin, and consume low-power. The liquid crystal display device includes a light source such as a Light Emitting Diode (LED). Strings of LEDs have been implemented and driven by various current driving circuits.

For example, FIG. 13A is a block diagram schematically illustrating a conventional LED backlight device and FIG. 13B is a circuit diagram of a convention current driving circuit of FIG. 13A. LED backlight device 100 includes a DC power supply 101, a DC converter 102, a bottom detecting circuit 103, LED strings 104, 105, 106, 107, and current driving circuits 108, 109, 110, 111.

The DC converter 102 converts a DC voltage supplied from the DC power supply 101 into a DC voltage needed to switch on the LED strings 104, 105, 106, 107 to provide the converted DC voltage to the LED strings 104, 105, 106, 107, respectively. The current driving circuit 108, as illustrated in FIG. 13B, includes an error amplifier 108*a*, a Field Effect Transistor (FET) 108*b*, and a resistor R. The current driving circuits 109, 110, 111 may be configured to be substantially the same as that in FIG. 13B. With the current driving circuit 108, current flowing into a source electrode of the FET 108*b* from a corresponding LED string 104 is detected by the resistor R, and the error amplifier 108*a* compares the detected voltage with a reference voltage REF to control a voltage being supplied to a gate electrode of the FET 108*b*. The current flowing via the LED string 104 can be constantly controlled by controlling a gate voltage of the FET 108*b*. As described above, the gate voltage of the FET 108*b* can be controlled such that the current constantly flows via the resistor R and a drain electrode of the FET 108*b*.

Returning to FIG. 13A, the bottom detecting circuit 103 detects one having a minimum value from among voltages of respective lowermost cathodes of the LED strings 104, 105, 106, 107, and outputs a minimum value detection signal to the DC converter 102. Forward voltages of the LED strings 104, 105, 106, 107 may be different from one another due to a difference between elements. For this reason, although currents flowing via the LED strings 104, 105, 106, 107 are constantly controlled by the current driving circuits 108, 109, 110, 111, respectively, forward voltages of the LED strings 104, 105, 106, 107 may be different from one another. The DC converter 102 may need to supply a DC voltage greater than a maximum forward voltage among the forward voltages of the LED strings 104, 105, 106, 107. A difference between LED forward voltages can arise due to a difference between peripheral temperatures of the LED strings 104, 105, 106, 107. The bottom detecting circuit 103 may force DC voltages supplied to the LED strings 104, 105, 106, 107 to be adjusted to a required minimum value by detecting one, having a minimum value, from among voltages of respective lowermost cathodes of the LED strings 104, 105, 106, 107 and outputting a minimum value detection signal to the DC converter 102. That is, the DC converter 102 may adjust DC voltages being supplied to the LED strings 104, 105, 106, 107 such that a voltage level of the minimum value detection signal provided from the bottom detecting circuit 103 becomes constant.

In addition to the above-described driving circuit, a driving circuit for an LED backlight is disclosed in JP Laid-open No. 2007-208113. With an LED driving device disclosed in JP Laid-open No. 2007-208113, low-power driving is made by detecting a terminal voltage of each serial LED group and controlling the terminal voltage so as to become a power supply voltage needed for the whole.

An LED driving device disclosed in JP Laid-open No. 2009-54998 uses a low current control manner in which a driving voltage is supplied to an LED group via a transformer, a current flowing upon switching-on of the LED group is detected, and the detected current is controlled to have a predetermined current value.

A light emitting diode switching device disclosed in JP Domestic re-publication of PCT international application No. 2007-69371 is configured such that a current is alternately output to a serial LED group from a plurality of boosting circuits being connected in parallel, the serial LED group is grounded via a resistor, and a voltage across the resistor is fed back so as to be constant.

An LED driving circuit disclosed in JP Laid-open No. 2006-319221 has a shunt coil formed by connecting one end of each of two coils via a tap and two rectifier diodes each respectively connected to one end and the other end of the shunt coil, and respective serial LED groups are connected to two rectifier diodes. With this configuration, increase in a temperature or a life difference due to an irregular quantity of light and different current values is suppressed.

In the above-described LED backlight device 100, the current driving circuits 108 through 111 may be a constant current circuit which is configured to constantly control the current flowing at the drain electrode of the FET 108*b*. Power loss of the LED backlight device 100 may be determined by the product of an output voltage and a constant current of the constant current circuit. If the output voltage of the constant current circuit becomes high, power loss may increase. That is, heat may be generated. If the difference between forward voltages of the LED strings 104, 105, 106, 107 becomes large, a DC voltage supplied from the DC converter 102 may increase excessively, and output voltages of the current driving circuits 108, 109, 110, 111 may increase, generating heat. This problem may not be solved via devices disclosed in the above-described references. Further, the LED backlight device 100 may necessitate the bottom detecting circuit 103 as a feedback circuit. Devices disclosed in the above-described references may necessitate a feedback circuit for detecting a current or a terminal voltage of an LED group. For this reason, a control system may be complicated, and it may be troublesome to adjust circuit parameters. A need therefore exists for a less-complicated, heat minimizing approach to driving strings of LEDs in an LCD backlight device.

SUMMARY

According to an exemplary embodiment an LED backlight device includes an inverter having an input connected to a DC power supply and configured to output an AC current, a plurality of transformers each configured to drop the AC current input from the inverter, input sides of the transformers being connected in series with respect to an output of the inverter and output sides of the transformers being disposed in parallel, a plurality of full-wave rectification circuits respectively connected to the output sides of the transformers, and configured to full-wave rectify the dropped AC currents, respectively, a plurality of smoothing circuits respectively connected to outputs of the plurality of full-wave rectification circuits, and configured to smooth the full-wave rectified currents to output DC currents, respectively, and a plurality of LED strings respectively connected to outputs of the smoothing circuits and each of the LED strings having a plurality of LEDs.

Each of the full-wave rectification circuits may include a diode bridge circuit, and cathode sides of the LED strings and anode sides of the full-wave rectification circuits are connected to a common ground, one end of the serially connected input sides of the transformers being connected to the common ground and the other end of the serially connected input sides of the transformers being connected to the output of the inverter.

Inductance values of the output sides of the transformers may be set to be larger than impedance values of the LED strings.

The LED backlight device may further include a DC converter having an input connected to the DC power supply and an output connected to a common node of the full-wave rectification circuits and configured to output a DC voltage for compensating for a voltage corresponding to a difference between forward voltages of the LED strings.

The DC converter may be further configured to set the DC voltage to a maximum voltage by which the LED strings are not switched on.

Each of the full-wave rectification circuits may include a diode bridge circuit, and cathode sides of the LED strings and anode sides of the full-wave rectification circuits may be connected to a common ground, one end of the serially connected input sides of the transformers being connected to the common ground and the other end of the serially connected input sides of the transformers being connected to the output of the inverter.

According to an exemplary embodiment an LED backlight device includes an inverter having an input connected to a DC power supply and configured to output an AC voltage, a plurality of transformers each configured to output AC currents, input windings of the transformers being connected in series to form a loop, output windings of transformers being disposed in parallel, and one end of the output windings of the transformers being connected in parallel to an output of the inverter, a plurality of rectification circuits respectively connected to the other ends of the output windings of the transformers, and configured to rectify the AC currents from the transformers to output positive currents and negative currents, respectively, a plurality of smoothing circuits respectively connected to outputs of the rectification circuits, and configured to smooth the positive and negative currents to output positive and negative DC currents, respectively, and a plurality of LED strings respectively connected to outputs of the smoothing circuits and each of the LED strings having a plurality of LEDs.

Each of the rectification circuits may include a first rectification element configured to output a positive current and a second rectification element configured to output a negative current, and the LED strings includes first LED strings and second LED strings, anode sides of the first LED strings being connected to outputs of first rectification elements of the rectification circuits and the smoothing circuits, respectively, and cathode sides of the second LED strings being connected to outputs of second rectification elements of the rectification circuits and the smoothing circuits, respectively.

Cathode sides of the first LED strings and anode sides of the second LED strings may be connected to a common ground.

Inductance values of the input windings of the transformers and inductance values of the output windings of the transformers may be adjusted such that the same input AC currents flow into the input windings of the transformers and the same output AC currents flow into the output windings of the transformers.

According to an exemplary embodiment an LED backlight device includes an inverter having an input connected to a DC power supply and configured to output an AC voltage, a transformer having an input winding and an output winding wound in a reverse direction and configured to output an AC current, one end of the input winding and one end of the output winding being connected in parallel to an output of the inverter, a plurality of rectification circuits respectively connected to the other end of the input winding and the other end of the output winding, and configured to rectify AC currents output from the other end of the input winding and the other end of the output winding to output positive currents and negative currents, respectively, a plurality of smoothing circuits respectively connected to outputs of the rectification circuits, and configured to smooth the positive and negative currents to output positive and negative DC currents, respectively, and a plurality of LED strings respectively connected to outputs of the smoothing circuits and each of the LED strings having a plurality of LEDs.

Each of the rectification circuits may include a first rectification element outputting a positive current and a second rectification element outputting a negative current, and the LED strings may include first LED strings and second LED strings, anode sides of the first LED strings being connected to outputs of first rectification elements of the rectification circuits and the smoothing circuits, respectively, and cathode sides of the second LED strings being connected to outputs of second rectification elements of the rectification circuits and the smoothing circuits, respectively.

Cathode sides of the first LED strings and anode sides of the second LED strings may be connected to a common ground.

According to an exemplary embodiment a backlight device for a liquid crystal display device, includes a plurality of light emitting diode strings, each light emitting diode string comprising a series of diodes coupled in series, one end of each diode string coupled to ground, an inverter configured to convert a DC voltage supplied from a DC power source into an AC voltage having a predetermined frequency and amplitude, one or more transformers configured to receive the AC voltage, a plurality of rectification circuits whose respective input sides are configured to receive an AC voltage from a respective transformer, and a plurality of capacitors, each capacitor coupled between a non-grounded end of a respective light emitting diode string and an output of a respective rectification circuit.

The rectification circuits may include full-wave rectification circuits whose outputs are connected to respective non-grounded ends of the light emitting diode strings.

One end of a first light emitting diode string of a pair of light emitting diode strings may have its anode coupled to ground and one end of a second light emitting diode string of the pair of light emitting diode strings may have its cathode coupled to ground. The rectification circuits may include diode pairs, an anode of one of diode pairs being coupled to the non-grounded end of the first light emitting diode pair and a cathode of the second one of the diode pairs being coupled to the non-grounded end of the second light emitting diode string pair.

The DC power source may be a DC power supply.

The DC power source may include an AC/DC rectification unit configured to receive an AC power supply voltage from an AC outlet and to provide an input DC voltage, and a DC/DC converter configured to convert the input DC voltage from the AC/DC rectification unit into the DC voltage received by the inverter.

BRIEF DESCRIPTION OF THE DRAWINGS

The following figures are referred to in the present disclosure, wherein like reference numerals refer to like parts throughout the various figures unless otherwise specified.

DETAILED DESCRIPTION

The inventive concept is described more fully hereinafter with reference to the accompanying drawings, in which exemplary embodiments of the inventive concept are shown. This inventive concept may, however, be embodied in many different forms and should not be construed as limited to the exemplary embodiments set forth herein. Rather, these embodiments are provided so that this disclosure will be thorough and complete, and will fully convey the scope of the inventive concept to those skilled in the art.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the inventive concept.

Figure 1:
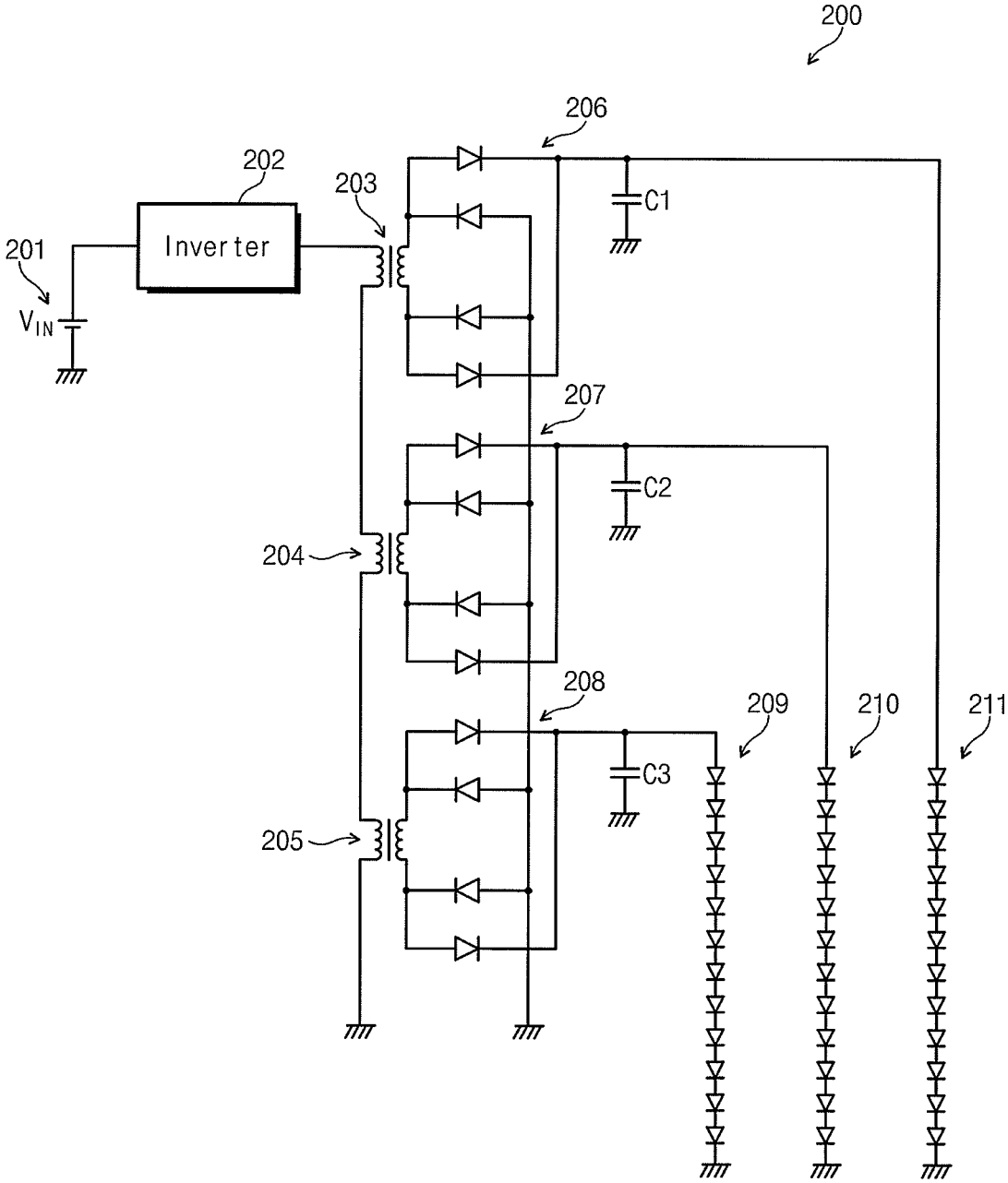
FIG. 1 is a circuit diagram schematically illustrating an LED backlight device according to an exemplary embodiment of the inventive concept.

FIG. 1 is a circuit diagram schematically illustrating an LED backlight device 200 according to an exemplary embodiment of the inventive concept.

Referring to FIG. 1, an LED backlight device 200 may include a DC power supply 201, an inverter 202, transformers 203, 204, 205, full-wave rectification circuits 206, 207, 208, LED strings 209, 210, 211, and capacitors C1, C2, C3. In FIG. 1, there is illustrated the case where the LED backlight device 200 includes three LED strings 209, 210, 211. However, the inventive concept is not limited thereto. For example, in an exemplary embodiment the number of LED strings can be less than or more than three. That is, since the number of LED strings is changed according to the size of a liquid crystal display device, the number of each of constituent elements such as transformers, full-wave rectification circuits, and capacitors can be changed accordingly.

The inverter 202 may have an input connected to the DC power supply 201 and an output connected to an input (or, primary) side of the transformer 203. The inverter 202 may convert the DC voltage supplied from the DC power supply 201 into an AC voltage having predetermined frequency and amplitude. The AC voltage may be supplied to the transformer 203.

Input sides of the transformers 203, 204, 205 may be connected in series, and output (or, secondary) sides thereof may be connected in parallel with input sides of the full-wave rectification circuits 206, 207, 208, respectively. The respective turn ratios of the input and output sides of the transformers 203, 204, 205 may be the same as one another. The other end of the transformer 205 may be grounded. Since the input sides of the transformers 203, 204, 205 are connected in series, the AC voltage supplied to the input side of the transformer 203 may be supplied to the input sides of the transformers 204, 205. The transformers 203, 204, 205 may boost the input AC voltage according to the turn ratio to output the boosted voltages to corresponding full-wave rectification circuits 206, 207, 208, respectively. The turn ratios of the transformers 203, 204, 205 may be determined considering a DC voltage needed for switching on the LED strings 209, 210, 211.

Each of the full-wave rectification circuits 206, 207, 208 may be formed of four diodes connected as illustrated in FIG. 1. Inputs of the full-wave rectification circuits 206, 207, 208 may be connected to the output sides of the transformers 203, 204, 205, respectively, and outputs of the full-wave rectification circuits 206, 207, 208 may be connected to the capacitors C1, C2, C3, respectively. Anodes of two diodes within each of the full-wave rectification circuits 206, 207, 208 may be grounded. The full-wave rectification circuits 206, 207, 208 may full-wave rectify boosted AC voltages input from the corresponding transformers 203, 204, 205, respectively. The capacitors C1, C2, C3 may smooth voltages full-wave rectified by the corresponding full-wave rectification circuits 206, 207, 208 to supply the smoothed voltages to corresponding LED strings 209, 210, 211 as a DC voltage, respectively. Those skilled in the art will appreciate that a further voltage regulator can follow capacitors C1, C2, C3. The voltage regulator could serve both to remove the last of the voltage ripple and to deal with variations in supply and load characteristics.

In an exemplary embodiment, each of the LED strings 209, 210, 211 may include twelve LEDs being connected in series. An anode of an LED placed at an input side of the LED string 211 may be connected to a connection node between an output of the full-wave rectification circuit 206 and the capacitor C1, and a cathode thereof may be grounded. An anode of an LED placed at an input side of the LED string 210 may be connected to a connection node between an output of the full-wave rectification circuit 207 and the capacitor C2, and a cathode thereof may be grounded. An anode of an LED placed at an input side of the LED string 209 may be connected to a connection node between an output of the full-wave rectification circuit 208 and the capacitor C3, and a cathode thereof may be grounded.

In FIG. 1, there is illustrated an exemplary embodiment wherein each of LED strings 209, 210, 211 is formed of twelve LEDs. However, the inventive concept is not limited thereto. For example, in an exemplary embodiment the number of LEDs in each LED string can be less than or more than twelve. That is, the number of LEDs in each LED string can be changed as needed according to the size of the liquid crystal display device or the like.

In operation, a DC voltage $V_{IN}$ supplied from the DC power supply 201 may be converted into an AC current having a predetermined frequency and amplitude via the inverter 202. The AC current may be supplied to the input side of the transformer 203. Likewise, the AC current supplied to the input side of the transformer 203 may be supplied to the input sides of the transformers 204, 205 connected in series to the input side of the transformer 203.

The AC currents supplied to the input sides of the transformers 203, 204, 205 may be dropped by the same turn ratios, and AC currents having the same amplitude may be output to the full-wave rectification circuits 206, 207, 208 connected to the output sides of the transformers 203, 204, 205. The full-wave rectification circuits 206, 207, 208 may full-wave rectify dropped AC currents input from the transformers 203, 204, 205, respectively. The capacitors C1, C2, C3 may smooth ripples in the currents full-wave rectified by the corresponding full-wave rectification circuits 206, 207, 208 to supply the smoothed currents to corresponding LED strings 209, 210, 211 as a DC current, respectively. Since the same DC current is supplied to the LED strings 209, 210, 211, the LED strings 209, 210, 211 may be switched on.

Figure 13A:
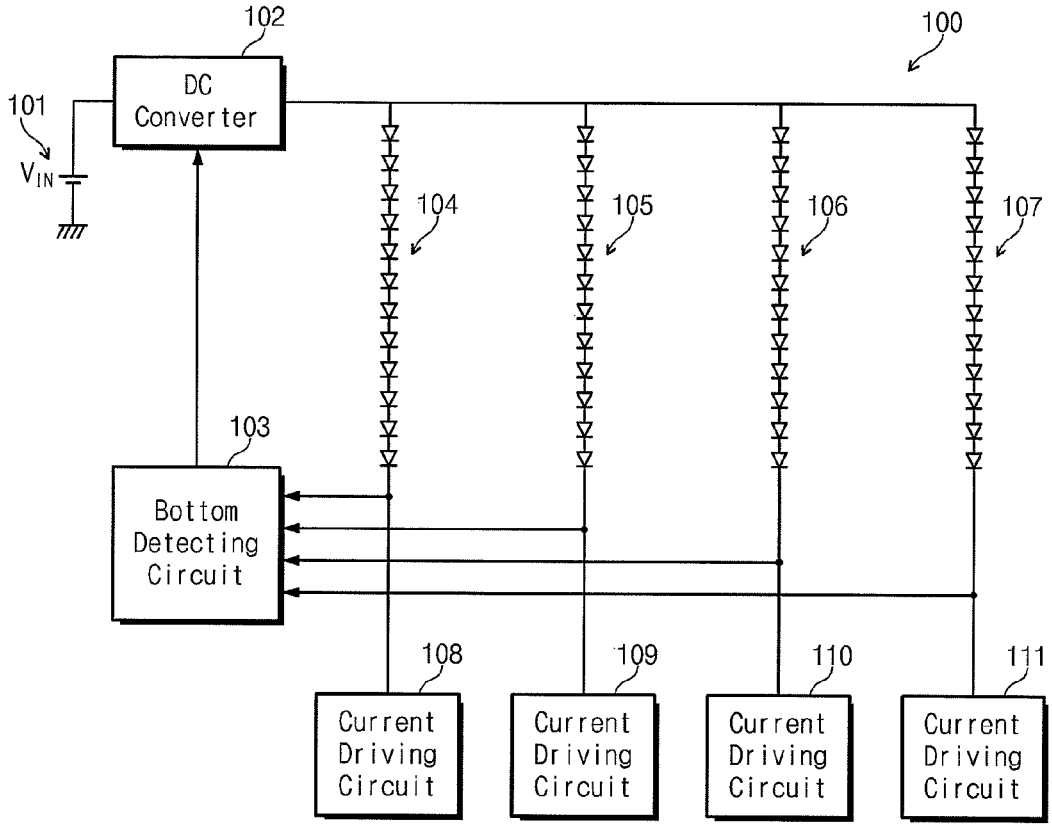
Fig. 13A (PRIOR ART)
FIG. 13A is a block diagram schematically illustrating a conventional LED backlight device.
Figure 13B:
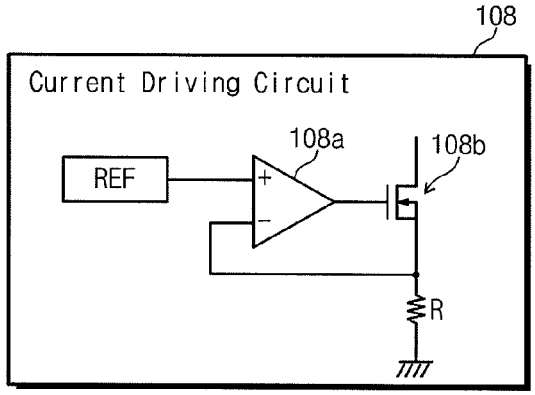
Fig. 13B (PRIOR ART)
FIG. 13B is a circuit diagram of a conventional current driving circuit of FIG. 13A.

With the above-described LED backlight device 200, since a constant current circuit is implemented without using current driving circuits 108, 109, 110 111 included in an LED backlight device 100 described in relation to FIG. 13A, it is possible to simplify a circuit structure and to reduce a heat loss.

Further, the LED backlight device 200 may not necessitate a bottom detecting circuit 103 as described in relation to FIG. 13A. Currents flowing via the LED strings 209, 210, 211 may be controlled constantly by just stabilizing currents of input sides of the transformers 203, 204, 205. Since an output of a constant current circuit formed of the transformers 203, 204, 205, the full-wave rectification circuits 206, 207, 208, and the capacitors C1, C2, C3 is connected to anode sides of the LED strings 209, 210, 211, cathode sides of the LED strings 209, 210, 211 may be grounded. Therefore, it becomes easy to connect the cathode sides of the LED strings 209, 210, 211, anode sides of the full-wave rectification circuits 206, 207, 208, and one end of serially connected input sides of the transformers 203, 204, 205 (the other end being connected to the output side of the inverter 202), to a common ground, for example, a case of a liquid crystal display device. In other words, arrangement of a ground wiring need not be an implementation factor. On the other hand, for the LED backlight device 100 in FIG. 13A, each circuit needs to be connected to a ground terminal via a cable from a terminal for ground, independently. However, in accordance with the exemplary embodiment of the LED backlight device 200 depicted in FIG. 1, it becomes possible to simplify the structure associated with ground wiring within a liquid crystal display device. A constrain current circuit formed of the transformers 203, 204, 205, the full-wave rectification circuits 206, 207, 208, and the capacitors C1, C2, C3 may be connected to the LED strings 209, 210, 211. In this case, although impedance values of ground sides of the LED strings 209, 210, 211 are different from one another, a constant current may flow via the LED strings 209, 210, 211, and impedance adjustment may be unnecessary. Currents flowing into the LED strings 209, 210, 211 may be constant by setting inductance values of the output sides of the transformers 203, 204, 205 to be larger than impedance values of the LED strings 209, 210, 211. In this case, currents of the LED strings 209, 210, 211 can be the same as one another.

An LED backlight device according to an exemplary embodiment of the inventive concept will now be described with reference to FIG. 2, wherein the LED backlight device further includes a DC converter 312.

Figure 2:
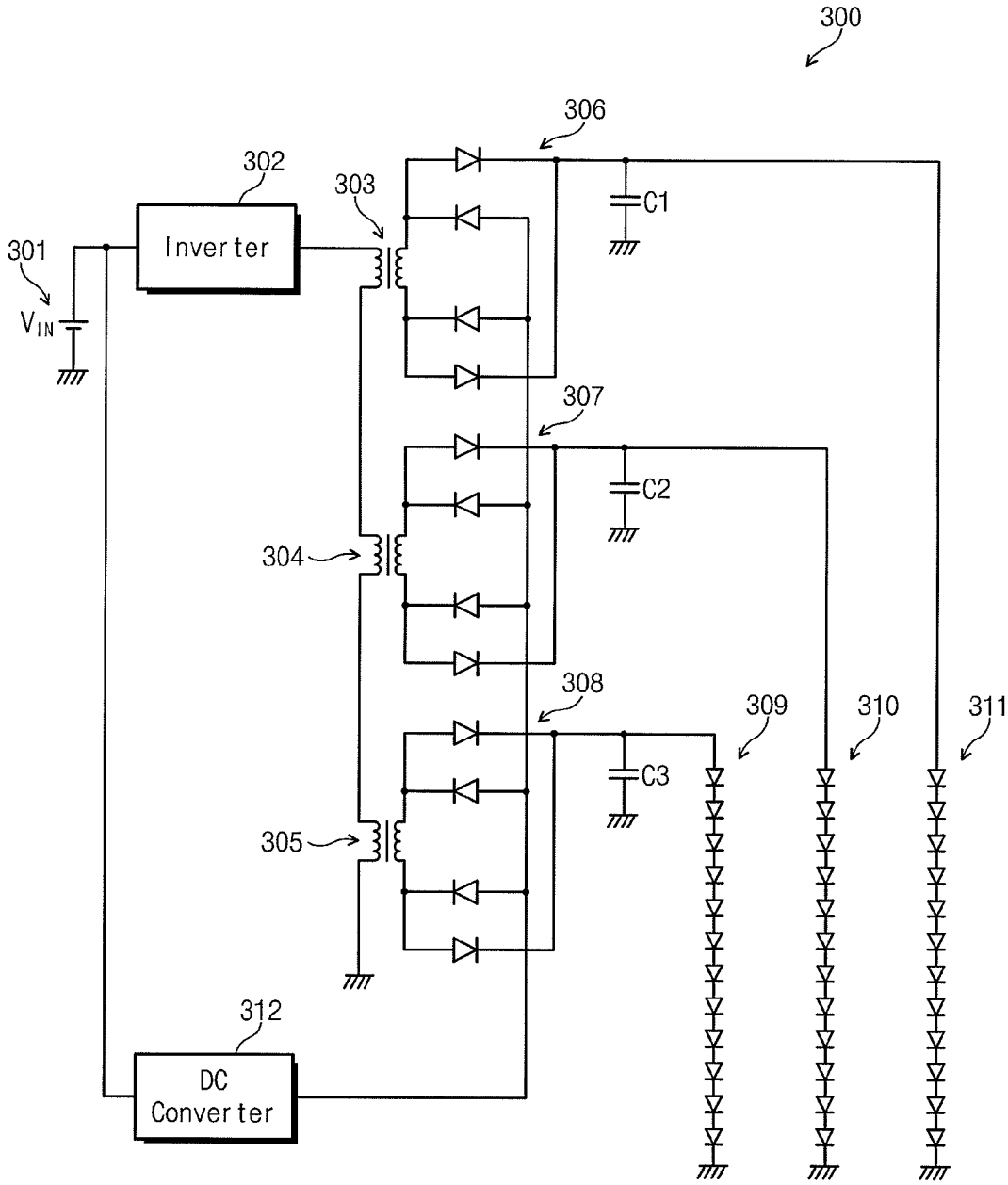
FIG. 2 is a circuit diagram schematically illustrating an LED backlight device according to an exemplary embodiment of the inventive concept.

As depicted in FIG. 2, an LED backlight device 300 may include a DC power supply 301, an inverter 302, transformers 303, 304, 305, full-wave rectification circuits 306, 307, 308, LED strings 309, 310, 311, a DC converter 312, and capacitors C1, C2, C3. In FIG. 2, there is illustrated the case where the LED backlight device 300 includes three LED strings 309, 310, 311. However, the inventive concept is not limited thereto. For example, the number of LED strings can be less or more than three. That is, since the number of LED strings is changed according to a size of a liquid crystal display device, the number of each of constituent elements such as transformers, full-wave rectification circuits, and capacitors can be changed accordingly. The constituent elements 302, 303, 304, 305, 306, 307, 308, 309, 310, 311, and C1, C2, C3 in FIG. 2 may be substantially identical to those 202, 203, 204, 205, 206, 207, 208, 209, 210, 211, and C1, C2, C3 in FIG. 1, and description thereof is thus omitted.

An input side of the DC converter 312 may be connected to the DC power supply 301, and its output side may be connected to anodes (a common node) of the full-wave rectification circuits 306, 307, 308. The DC converter 312 may apply a DC voltage corresponding to a difference between forward voltages of the LED strings 309, 310, 311 to the anodes of the full-wave rectification circuits 306, 307, 308. This may be made to compensate for a DC voltage corresponding to a difference between forward voltages of the LED strings 309, 310, 311. Therefore, the DC converter 312 may set a DC voltage level to the maximum voltage by which the LED strings 309, 310, 311 are not switched on.

In operation, a DC voltage $V_{IN}$ supplied from the DC power supply 301 may be converted into an AC current having a predetermined frequency and amplitude via the inverter 302. The AC current may be supplied to the input side of the transformer 303. Likewise, the AC current supplied to the input side of the transformer 303 may be supplied to the input sides of the transformers 304, 305 connected in series to the input side of the transformer 303.

The AC currents supplied to the input sides of the transformers 303, 304, 305 may be dropped by the same turn ratios, and AC currents having the same amplitude may be output to the full-wave rectification circuits 306, 307, 308 connected to the output sides of the transformers 303, 304, 305. The full-wave rectification circuits 306, 307, 308 may full-wave rectify dropped AC currents input from the transformers 303, 304, 305, respectively. The capacitors C1, C2, C3 may smooth currents full-wave rectified by the corresponding full-wave rectification circuits 306, 307, 308 to supply the smoothed currents to corresponding LED strings 309, 310, 311 as a DC current, respectively. Since the same DC current is supplied to the LED strings 309, 310, 311, the LED strings 309, 310, 311 may be switched on.

The DC converter 312 may supply the anodes of the full-wave rectification circuits 306, 307, 308 with a DC voltage set to the maximum voltage by which the LED strings 309, 310, 311 are not switched on. Currents from the full-wave rectification circuits 306, 307, 308 may be reduced by the DC voltage from the DC converter 312 so as to be set to a lower limit value for turning on the LED strings 309, 310, 311. Therefore, amplitudes of currents output from the full-wave rectification circuits 306, 307, 308 may be smaller than amplitudes of currents output from full-wave rectification circuits 206, 207, 208 described in relation to FIG. 1. As such, power consumption is reduced.

The LED backlight device 300 according to the exemplary embodiment of the inventive concept may additionally include the DC converter 312 such that a DC voltage for compensating for a difference between forward voltages of the LED strings 306 through 311 is supplied to anodes of the full-wave rectification circuits 306, 307, 308. Since amplitudes of output currents of the transformers 303, 304, 305 are reduced, high-performance diodes with a low withstand voltage may be used as diodes of the full-wave rectification circuits 306, 307, 308. Since power for driving the LED strings 309, 310, 311 is mostly supplied from the DC converter 312, the transformers 303, 304, 305 may be miniaturized, inductance values of output sides of the transformers 303, 304, 305 may be reduced, and penetration powers of the transformers 303, 304, 305 may be reduced. Accordingly, power consumed by the LED backlight device 300 may be reduced.

A circuit structure for simulating the operation of the LED backlight device 300 in FIG. 2 will now be described with reference to FIG. 3. A simulation circuit 400 in FIG. 3 may be configured by replacing an inverter 302 of the LED backlight device 300 in FIG. 2 with an AC power supply 402, LED strings 309, 310, 311 with resistive loads R1, R2, R3, and a DC converter 312 with a DC power supply 412.

Figure 3:
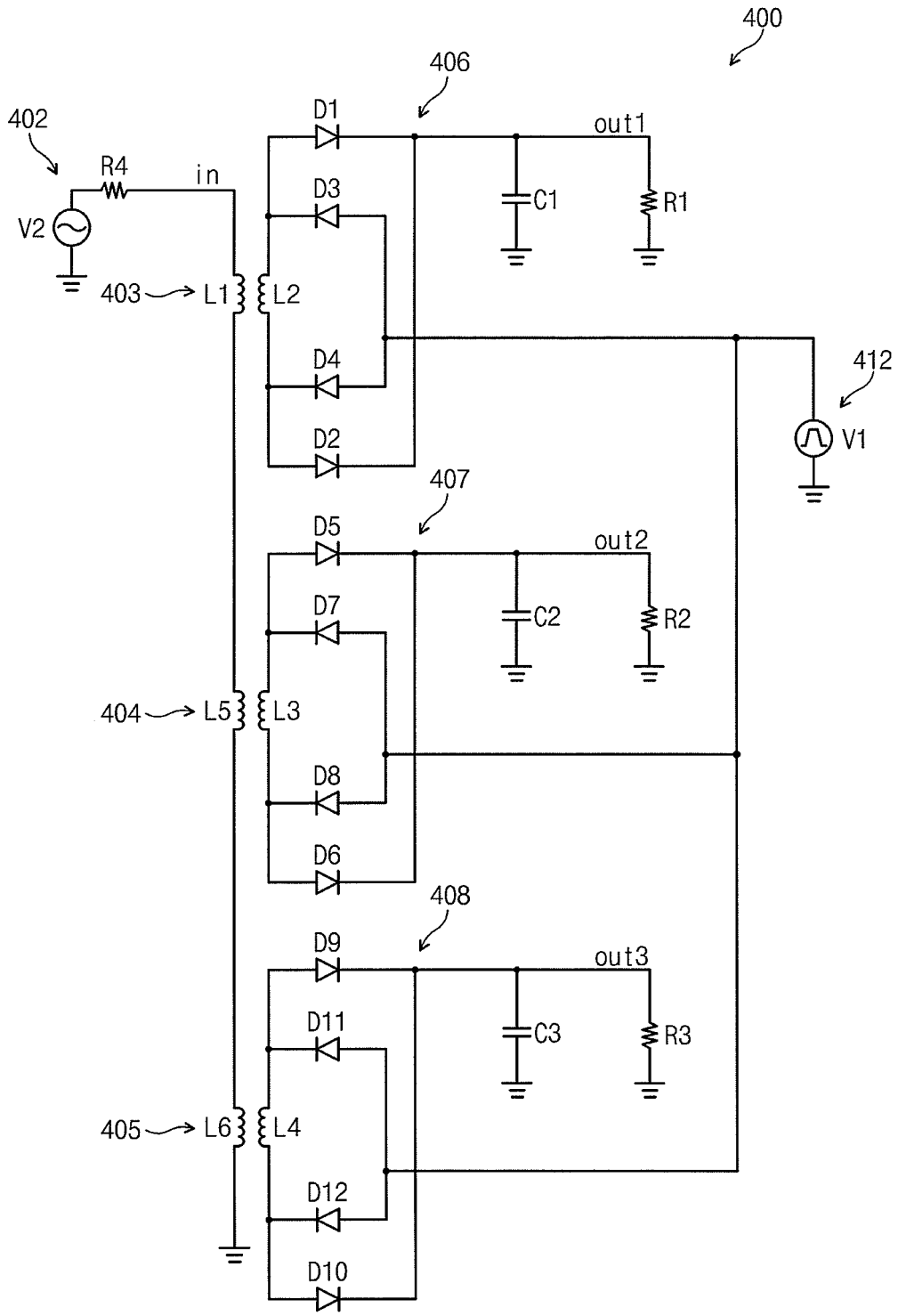
FIG. 3 is a diagram schematically illustrating a circuit structure for simulating the operation of the LED backlight device of FIG. 2.

Referring to FIG. 3, the simulation circuit 400 may include an AC power supply 402 as an inverter, transformers 403, 404, 405, full-wave rectification circuits 406, 407, 408, resistive loads R1, R2, R3 as LED strings, a DC power supply 412 as a DC converter, and capacitors C1, C2, C3.

The AC power supply 402 may supply an AC voltage V2 with a predetermined frequency and amplitude to the transformers 403, 404, 405. The transformers 403, 404, 405 may have the same turn ratios as transformers 303, 304, 305 in FIG. 2. The transformers 403, 404, 405 may drop AC currents supplied by the AC voltage V2 according to the turn ratios to output AC currents with the same amplitude to the full-wave rectification circuits 406, 407, 408. Each of the full-wave rectification circuits 406, 407, 408 may be formed of four diodes. The full-wave rectification circuits 406, 407, 408 may full-wave rectify the dropped AC currents input from the transformers 403, 404, 405. The capacitors C1, C2, C3 may smooth full-wave rectified currents so as to be provided to the resistive loads R1, R2, R3 as a DC current. The DC power supply 412 as a DC converter may output 170V as a fixed DC voltage V1, for example.

Figure 4A:
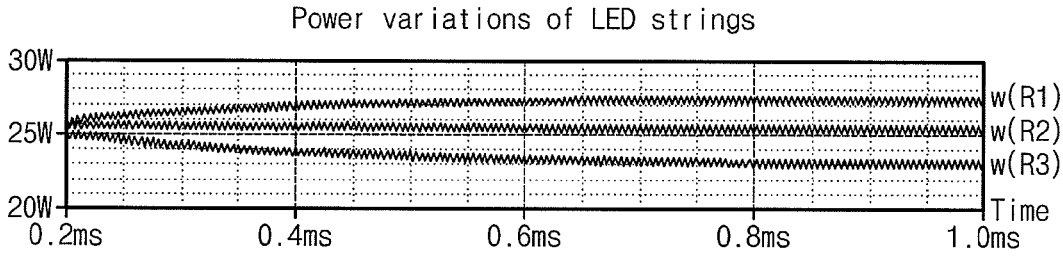
FIGS. 4A, 4B, 4C, 4D and 4E are diagram showing signals of respective components within the LED backlight device of FIG. 3.
Figure 4B:
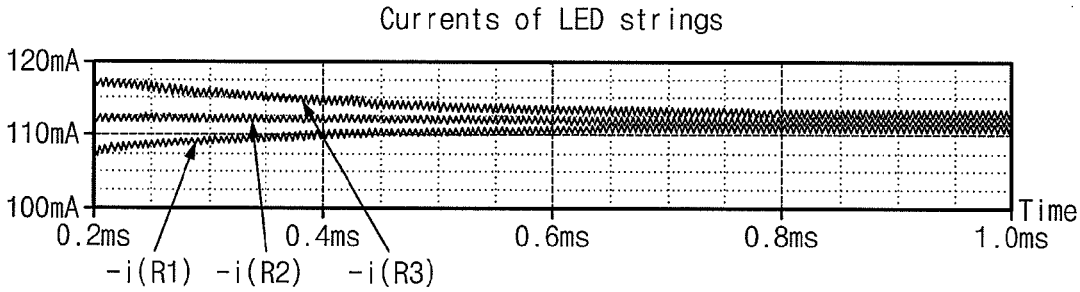
Figure 4C:
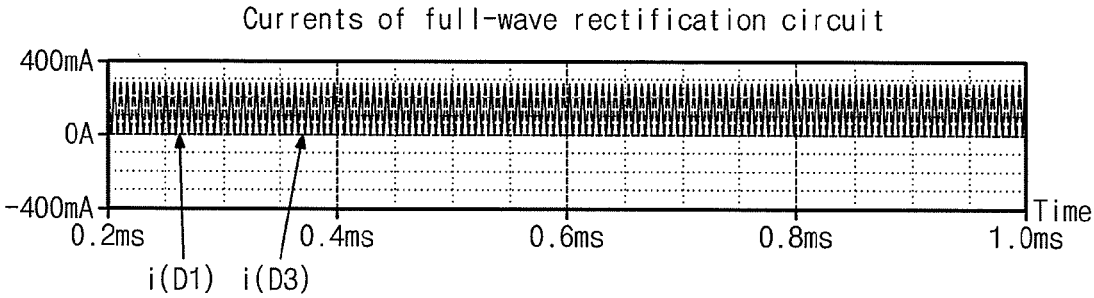
Figure 4D:
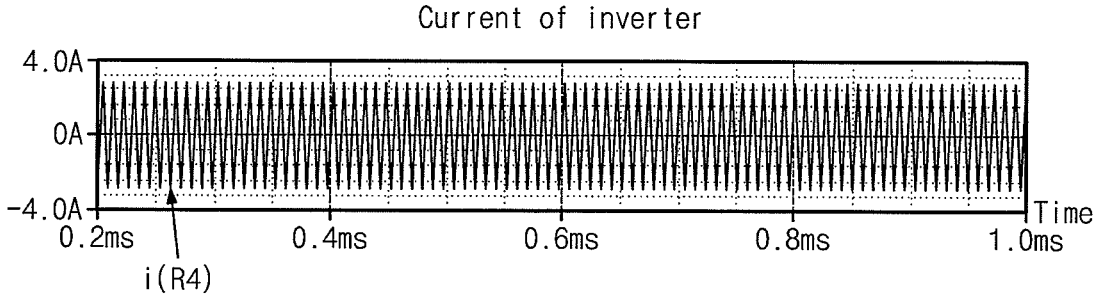
Figure 4E:
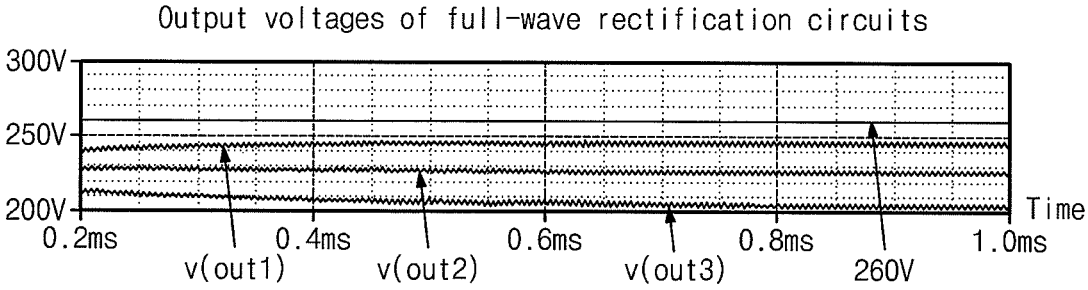

The operation of the simulation circuit 400 will now be described with reference to FIGS. 4A through 4E which show signals of respective components within the LED backlight device 300. FIG. 4A shows power losses w(R1), w(R2), and w(R3) of resistive loads R1, R2, R3. FIG. 4B shows currents −i(R1), −i(R2), −i(R3) flowing via the resistive loads R1, R2, R3 as LED strings. FIG. 4C shows currents i(D1), i(D3) flowing via diodes D1, D3 of a full-wave rectification circuit 403. FIG. 4D shows a current i(R4) flowing into an AC power supply (an input side of a transformer 403) as an inverter, and FIG. 4E shows output voltages v(out1), v(out2), v(out3) of full-wave rectification circuits 403, 404, 405.

At a simulation operation of the LED backlight device 400, forward voltages of LED strings may be set to a maximum value, a minimum value, and a standard value considering variations of forward voltages due to a difference of the LED strings or a temperature variation.

As an ideal sinusoidal wave voltage generating device, the AC power supply 402 may be used as an inverter so as to supply an AC voltage to input sides of transformers 403, 404, 405.

As a DC converter, the DC power supply 412 may output a fixed DC voltage (e.g., 170V). In FIG. 3, there is shown the case where a pulse power supply is set, to perform a simulation operation from 0V at an initial operation.

In FIGS. 4A through 4E, the horizontal axis indicates a measurement time, and there are represented variations of signals during a period from 0.2 ms to 1.0 ms.

In FIG. 3, the AC power supply 402 as an inverter may generate a sinusoidal wave AC voltage having amplitude of ±24V. The current i(R4) flowing into an input side of a transformer 403 by the sinusoidal wave AC voltage may be as illustrated in FIG. 4D. If the sinusoidal wave AC voltage is applied to a full-wave rectification circuit 406 as an AC current dropped by the transformer 403, currents i(D1) and i(D3) flowing via diodes D1, D3 of the full-wave rectification circuit 406 may be as illustrated in FIG. 4C. Although not shown, currents i(D5), i(D7) flowing via diodes D5, D7 of the full-wave rectification circuit 407 and currents i(D9), i(D11) flowing via diodes D9, D11 of the full-wave rectification circuit 408 may be generated as illustrated in FIG. 4C.

Output voltages v(out1), v(out2), v(out3) of the full-wave rectification circuits 406, 407, 408 may be generated as illustrated in FIG. 4E. In this case, the output voltage v(out1) of the full-wave rectification circuit 406 may be about 240V, the output voltage v(out2) of the full-wave rectification circuit 407 may be about 230V, and the output voltage v(out3) of the full-wave rectification circuit 408 may be about 210V.

In the simulation circuit 400 of FIG. 3, resistive loads R1, R2, R3 simulating LED strings may be set to have different power losses to simulate a difference between forward voltages. As illustrated in FIG. 4A, a power loss w(R1) of the resistive load R1 may be about 27 W as a maximum value, a power loss w(R2) of the resistive load R2 may be about 25 W as a standard value, and a power loss w(R3) of the resistive load R3 may be about 23 W as a minimum value. A DC voltage for compensating a difference of power losses of the resistive loads R1, R2, R3 may be applied to anodes of diodes D3, D4, D7, D8, D11, D12 of the full-wave rectification circuits 406, 407, 408 from the DC power supply 412 as a DC converter.

Full-wave rectified currents output from the full-wave rectification circuits 406, 407, 408 may be smoothed by capacitors C1, C2, C3 so as to be supplied to the resistive loads R1, R2, R3 simulating LED strings. At this time, currents −i(R1), −i(R2), −i(R3) flowing via the resistive loads R1, R2, R3 may be converged to 110 mA as illustrated in FIG. 4B.

In the case of the simulation circuit 400 for simulating the operation of an LED backlight device 300 in FIG. 2, the resistive loads R1, R2, R3 simulating LED strings may be set to have different power losses for simulation of a forward voltage difference, and an output (i.e., a DC voltage) of the DC power supply 412 as a DC converter may be applied to anodes of diodes D3, D4, D7, D8, D11, D12 of the full-wave rectification circuits 406, 407, 408. As a result, currents flowing via the resistive loads R1, R2, R3 can be constant.

With the simulation operation of the LED backlight device 300 using the simulation circuit 400, currents −i(R1), −i(R2), −i(R3) flowing via the resistive loads R1, R2, R3 simulating LED strings may be constant by applying a DC voltage for compensating a difference of power losses of the resistive loads R1, R2, R3 to anodes of diodes D3, D4, D7, D8, D11, D12 of the full-wave rectification circuits 406, 407, 408.

An LED backlight device according to an exemplary embodiment of the inventive concept will now be described with reference to FIG. 5.

Figure 5:
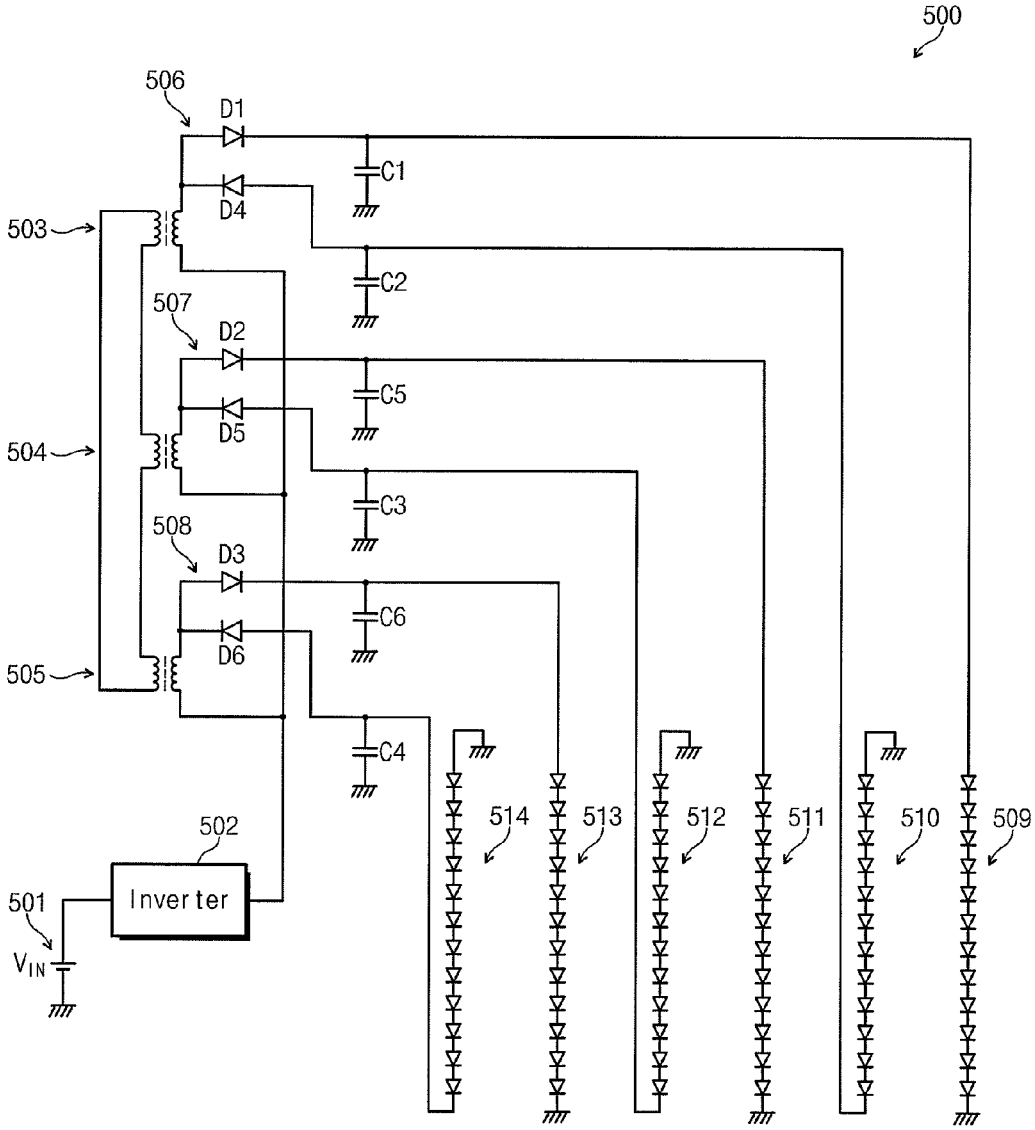
FIG. 5 is a circuit diagram schematically illustrating an LED backlight device according to an exemplary embodiment of the inventive concept.

Referring to FIG. 5, an LED backlight device 500 may include a DC power supply 501, an inverter 502, transformers 503, 504, 505, rectification circuits 506, 507, 508, LED strings 509, 510, 511, 512, 513, 514, and capacitors C1, C2, C3, C4, C5, C6. In FIG. 5, there is illustrated the case where the LED backlight device 500 includes six LED strings 509, 510, 511, 512, 513, 514. However, the inventive concept is not limited thereto. For example, the number of LED strings can be less or more than six. That is, since the number of LED strings is changed according to a size of a liquid crystal display device, the number of each of constituent elements such as transformers, rectification circuits, and capacitors can be changed accordingly.

An input side of the inverter 502 may be connected to the DC power supply 501, and one end of the output (or, secondary) windings of the transformers 503, 504, 505 may be connected in parallel to an output side of the inverter 502. The inverter 502 may convert a DC voltage supplied from the DC power supply 501 into an AC voltage having a predetermined frequency and amplitude. The AC voltage may be supplied to the transformers 503, 504, 505.

Input windings of the transformers 503, 504, 505 may be connected in series to form a loop, and the other end of the output windings of the transformers 503, 504, 505 may be connected to inputs of the rectification circuits 506, 507, 508, respectively. In the transformers 503, 504, 505, the respective turn ratios of the transformers 503, 504, 505 may be the same as one another.

Since input windings of the transformers 503, 504, 505 are connected in series to form a loop, the same AC current may flow via the input windings of the transformers 503, 504, 505. AC currents flowing via output windings of the transformers 503, 504, 505 alternately driven by the inverter 502 may be controlled similarly. The transformers 503, 504, 505 may output the same AC currents to the rectification circuits 506, 507, 508, respectively. The turn ratios of the transformers 503, 504, 505 may be determined considering a DC voltage for switching on the LED strings 509, 510, 511, 512, 513, 514. Inductance values of input and output windings of the respective transformers 503, 504, 505 may be adjusted such that the same input AC current flows into the input windings of the respective transformers 503, 504, 505 and the same output AC current flows into the output windings of the respective transformers 503, 504, 505.

The rectification circuits 506, 507, 508 may be formed of two diodes (or, diode pairs) (D1, D4), (D2, D5), (D3, D6), respectively. In the respective rectification circuits 506, 507, 508, an anode of one diode D1, D2, D3 and a cathode of the other diode D4, D5, D6 may be connected to the other end of an output winding of a corresponding transformer 503, 504, 505, a cathode of the one diode D1, D2, D3 may be connected to a corresponding capacitor C1, C5, C6, and an anode of the other diode D4, D5, D6 may be connected to a corresponding capacitor C2, C3, C4. Each of the rectification circuits 506, 507, 508 may rectify AC currents input from corresponding transformers 503, 504, 505 so as to output a positive current and a negative current.

The capacitors C1, C5, C6 may smooth rectified positive currents to supply positive DC currents to the LED strings 509, 511, 513, respectively. The capacitors C2, C3, C4 may smooth rectified negative currents to supply negative DC currents to the LED strings 510, 512, 514, respectively.

Each of the LED strings 509, 510, 511, 512, 513, 514 may be formed of twelve LEDs connected in series. Anode sides of the LED strings (or, first LED strings) 509, 511, 513 may be connected to connection nodes between diodes D1, D2, D3 of the rectification circuits 506, 507, 508 and the capacitors C1, C5, C6, respectively. Cathode sides of the LED strings (or, second LED strings) 510, 512, 514 may be connected to connection nodes between diodes D4, D5, D6 of the rectification circuits 506, 507, 508 and the capacitors C2, C3, C4, respectively. Cathode sides of the LED strings 509, 511, 513 and anode sides of the LED strings 510, 512, 514 may be connected to a common ground.

In FIG. 5, there is illustrated the case where each of the LED strings 509, 510, 511, 512, 513, 514 is formed of twelve LEDs. However, the inventive concept is not limited thereto. For example, the number of LEDs in each LED string can be less or more than twelve. That is, the number of LEDs in each LED string can be changed according to a size of a liquid crystal display device.

In operation, a DC voltage $V_{IN}$ supplied from the DC power supply 501 may be converted into an AC voltage with a predetermined frequency and amplitude via the inverter 502, and the AC voltage may be supplied to one end of an output winding of each of the transformers 503, 504, 505. Output windings of the transformers 503, 504, 505 may be driven by input AC voltages, respectively. The same input AC currents may flow into input windings connected in series to form a loop, and simultaneously, the same output AC currents may flow into the output windings.

The transformers 503, 504, 505 may output the same AC currents to the rectification circuits 506, 507, 508 connected to the other ends of the output windings of the transformers 503, 504, 505, respectively. In the rectification circuits 506, 507, 508, AC currents input from the transformers 503, 504, 505 may be rectified into positive currents and negative currents by diode pairs (D1, D4), (D2, D5), and (D3, D6), respectively. The capacitors C1, C2, C3, C4, C5, C6 may smooth positive and negative currents rectified by the rectification circuit 506, 507, 508 to supply positive and negative DC currents to the LED string 509, 510, 511, 512, 513, 514. The same positive DC currents and the same negative DC currents may be supplied to the LED strings 509, 510, 511, 512, 513, 514, so that the LED strings 509, 510, 511, 512, 513, 514 are switched on.

With the above-described LED backlight device 300, as compared with an LED backlight device 100 described in relation to FIG. 13A, it is possible to simplify a circuit structure and to reduce a heat loss. Currents flowing via the LED strings 509, 510, 511, 512, 513, 514 may be controlled constantly by just stabilizing an AC current output from the inverter 502. Since a constant current is supplied to anode sides of the LED strings 509, 510, 511, 512, 513, 514 and cathode sides of the LED strings 509, 510, 511, 512, 513, 514, the cathode sides and the anode sides of the LED strings 509, 510, 511, 512, 513, 514 may be grounded. Therefore, it may be easy to connect the cathode and anode sides of the LED strings 509, 510, 511, 512, 513, 514 to a common ground, for example, a case of a liquid crystal display device. In other words, arrangement of a ground wiring need not be an implementation factor. Further, it is possible to simplify a structure associated with the ground wiring within a liquid crystal display device by applying the LED backlight device 300 in FIG. 5 to a liquid crystal display device. A constant current circuit in FIG. 5 may be connected to the LED strings 509, 510, 511, 512, 513, 514. In this case, although impedance values of ground sides of the LED strings 509, 510, 511, 512, 513, 514 are different from one another, a constant current may flow via the LED strings 509, 510, 511, 512, 513, 514, and impedance adjustment may be unnecessary. The same current can be supplied to the LED strings 509, 510, 511, 512, 513, 514 by setting inductance values of input and output windings of the transformers 503, 504, 505 such that the same current flows A circuit structure for simulating the operation of an LED backlight device 500 in FIG. 5 will be described with reference to FIG. 6. The simulation circuit 600 in FIG. 6 may be configured by replacing an inverter 502 of the LED backlight device 500 in FIG. 5 with an AC power supply 602 and LED strings 509, 510, 511, 512, 513, 514 with resistive loads R1, R2, R3 and R5, R6, R7.

Figure 6:
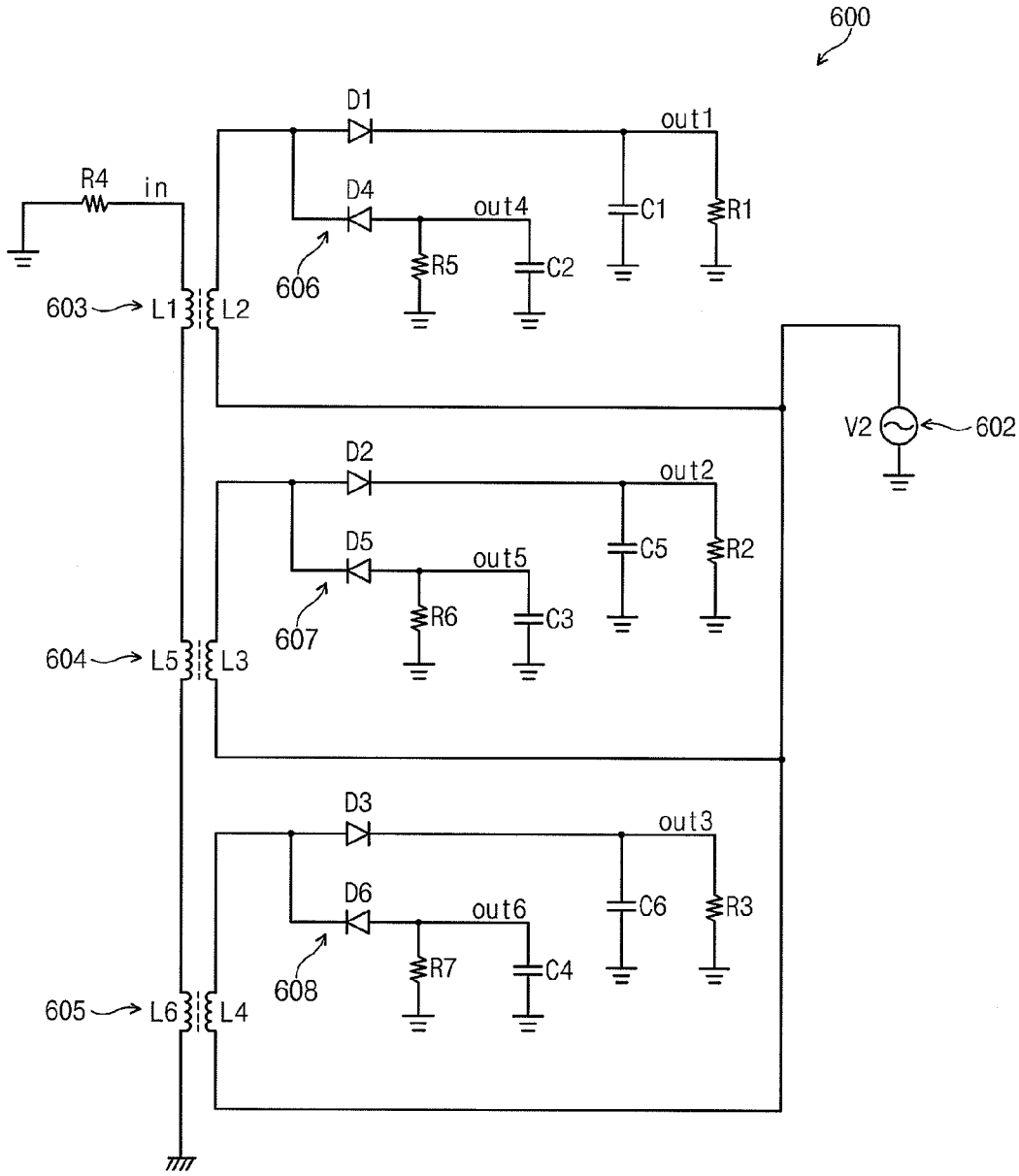
FIG. 6 is a diagram schematically illustrating a circuit structure for simulating the operation of the LED backlight device of FIG. 5.

Referring to FIG. 6, the simulation circuit 600 may include an AC power supply 602 as an inverter, transformers 603, 604, 605, rectification circuits 606, 607, 608, resistive loads R1, R2, R3 and R5, R6, R7 as LED strings, and capacitors C1, C2, C3, C4, C5, C6.

The AC power supply 602 may supply an AC voltage V2 with predetermined frequency and amplitude to one end of the output windings of the transformers 603, 604, 605. The transformers 603, 604, 605 may have the same turn ratios as transformers 503, 504, 505 in FIG. 5. The transformers 603, 604, 605 may output the same AC currents to the rectification circuits 606, 607, 608 using an input AC voltage V2. Each of the rectification circuits 606, 607, 608 may be formed of diode pairs (D1, D4), (D2, D5), (D3, D6), respectively. The rectification circuits 606, 607, 608 may rectify the AC currents input from the transformers 603, 604, 605 into positive and negative currents. The capacitors C1, C2, C3, C4, C5, C6 may smooth rectified positive and negative currents so as to be provided to the resistive loads R1, R2, R3 and R5, R6, R7 as positive and negative DC currents.

Figure 7A:
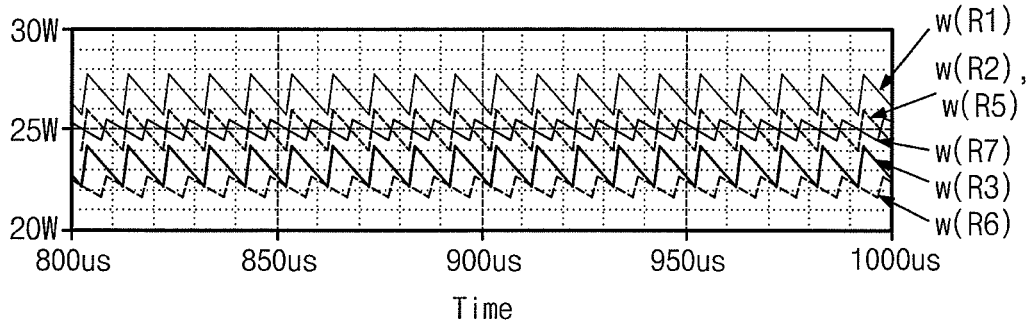
FIGS. 7A, 7B, 7C and 7D are diagram showing signals of respective components within the LED backlight device of FIG. 6.
Figure 7B:
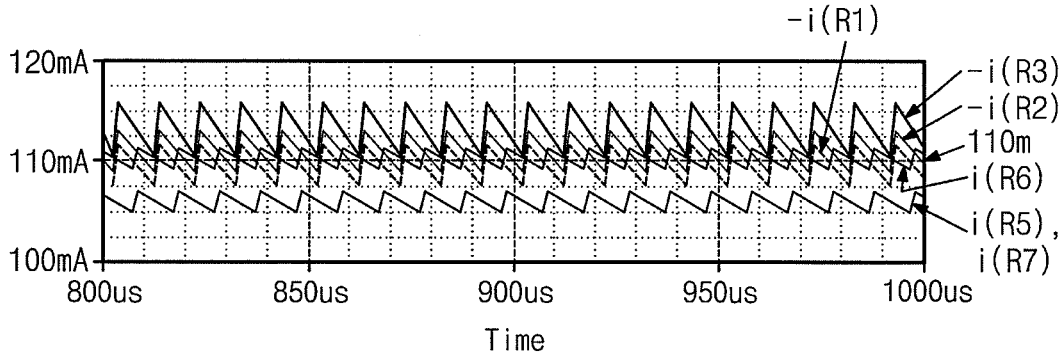
Figure 7C:
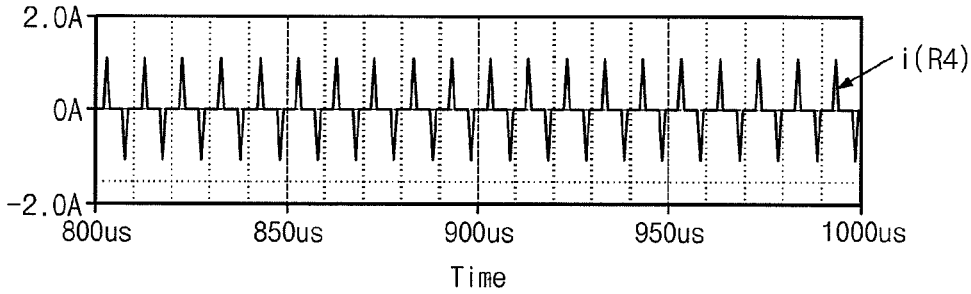
Figure 7D:
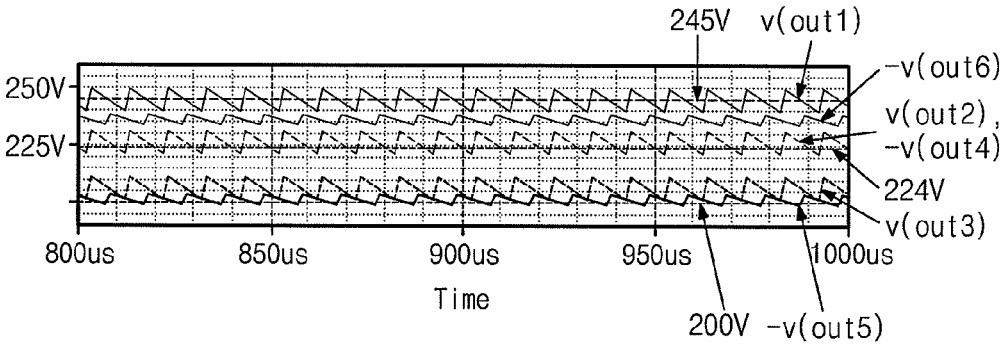

An operation of the simulation circuit 600 will be described with reference to FIGS. 7A through 7D which show signals of respective components within the LED backlight device 500. FIG. 7A shows power losses w(R1), w(R2), w(R3), w(R5), w(R6), w(R7) of resistive loads R1, R2, R3, R5, R6, R7, FIG. 7B shows currents −i(R1), −i(R2), −i(R3), i(R5), i(R6), i(R7) flowing via the resistive loads R1, R2, R3, R5, R6, R7 as simulated LED strings, FIG. 7C shows a current flowing via a resistor R4, and FIG. 7D shows output voltages v(out1) through v(out3) and −v(out4) through −v(out7) of rectification circuits 606, 607, 608.

At a simulation operation of the LED backlight device 500, a difference between forward voltages of LED strings may be considered. An AC power supply 602 may supply an AC voltage to output windings of transformers 603, 604, 605.

In FIGS. 7A through 7D, each horizontal axis indicates a measurement time, and there are represented variations of signals during a period from 800 μs to 1000 μs.

In FIG. 6, the AC power supply 602 as an inverter may generate a sinusoidal wave AC voltage having amplitude of 240V. The current i(R4) flowing into an input winding of a transformer 603 by the sinusoidal wave AC voltage may be as illustrated in FIG. 7C. Transformers 603, 604, 605 may be alternately driven by the sinusoidal wave AC voltage, and positive and negative currents may be rectified by applying the same AC current to rectification circuits 606, 607, 608. The rectified positive and negative currents may be smoothed by capacitors C1, C2, C3, C4, C5, C6 such that positive and negative DC currents are supplied to resistive loads R1, R2, R3 and R5, R6, R7 as simulated LED strings. At this time, currents flowing via the resistive loads R1, R2, R3 and R5, R6, R7 may be as illustrated in FIG. 7B.

In the simulation circuit 600 of FIG. 6, the resistive loads R1, R2, R3 and R5, R6, R7 simulating LED strings may be set to have different power losses to simulate a difference between forward voltages. As illustrated in FIG. 7A, a power loss w(R1) of the resistive load R1 may be about 27 W as a maximum value, power losses w(R2), w(R5), w(R7) of the resistive loads R2, R5, R7 may be about 25 W as a standard value, a power loss w(R3) of the resistive load R3 may be about 23 W, and a power loss w(R6) of the resistive load R6 may be about 22 W as a minimum value.

Positive and negative currents output from the rectification circuits 606, 607, 608 may be smoothed by capacitors C1, C2, C3, C4, C5, C6 so as to be supplied to the resistive loads R1, R2, R3 and R5, R6, R7 a simulated LED strings. At this time, currents −i(R1) through −i(R3) and i(R5) through i(R7) flowing via the resistive loads R1, R2, R3 and R5, R6, R7 may be converged to 110 mA as illustrated in FIG. 7B.

In the case of the simulation circuit 600 for simulating the operation of an LED backlight device 500 in FIG. 5, the resistive loads R1, R2, R3 and R5, R6, R7 as simulated LED strings may be set to have different power losses for simulation of a forward voltage difference. In this case, currents flowing via the resistive loads R1, R2, R3 and R5, R6, R7 may be constant.

With the simulation operation of the LED backlight device 500 using the simulation circuit 600, currents −i(R1) through −i(R3) and i(R5) through i(R7) flowing via the resistive loads R1, R2, R3 and R5, R6, R7 as simulated LED strings may be constant by outputting the same AC currents to the rectification circuits 606, 607, 608 from the transformers 603, 604, 605 driven by the AC power supply 602.

An LED backlight device according to an exemplary embodiment of the inventive concept will now be described with reference to FIG. 8 wherein the LED backlight device may be characterized in that input and output windings of a transformer are wound in an opposite direction and LED strings are connected in parallel to the input and output windings.

Figure 8:
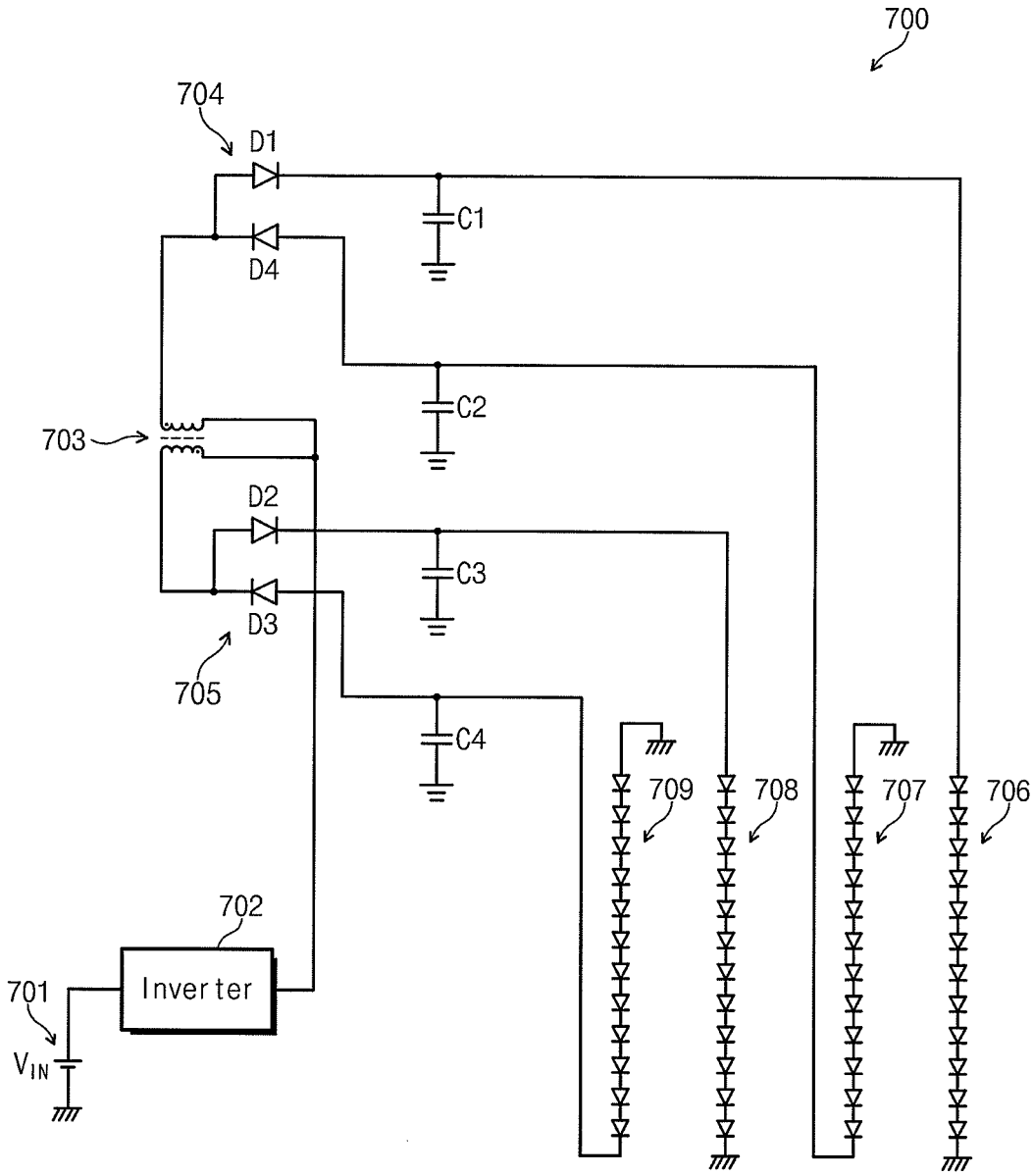
FIG. 8 is a circuit diagram schematically illustrating an LED backlight device according to an exemplary embodiment of the inventive concept.

Referring to FIG. 8, an LED backlight device 700 may include a DC power supply 701, an inverter 702, a transformer 703, rectification circuits 704 and 705, LED strings 706, 707, 708, 709, and capacitors C1 through C4. In FIG. 8, there is illustrated the case where the LED backlight device 700 includes four LED strings. However, the inventive concept is not limited thereto. For example, the number of LED strings can be less or more than four. That is, since the number of LED strings is changed according to the size of a liquid crystal display device, the number of each of constituent elements such as transformers, rectification circuits, and capacitors can be changed accordingly.

An input side of the inverter 702 may be connected to the DC power supply 701, and one end of the input and output (or, secondary) windings of the transformer 703 may be connected in parallel to an output side of the inverter 702. The inverter 702 may convert a DC voltage supplied from the DC power supply 701 into an AC voltage having a predetermined frequency and amplitude. The AC voltage may be supplied to the transformer 703.

Input and output windings of the transformer 703 may be wound in an opposite direction. One end of the input and output windings may be connected in parallel with an output side of the inverter 702, and the other end thereof may be connected to input sides of the rectification circuits 704 and 705, respectively. In the transformer 703, a turn (winding) number of an input side may be identical to that of an output side. The input and output windings of the transformer 703 may be connected such that the magnetic fluxes generated by the input and output windings according to the AC current supplied from the inverter 702 offset each other. A winding number of the respective input and output windings of the transformer 703 may be determined considering a DC voltage for switching on the LED strings 706, 707, 708, 709. AC currents flowing into the input and output windings of the transformer 703 driven by the inverter 702 may be controlled to be the same. Accordingly, the transformer 703 may supply the same. AC current to the rectification circuits 704, 705, respectively.

The rectification circuits 704, 705 may be formed of diode pairs (D1, D4), (D2, D3), respectively. In the rectification circuit 704, an anode of one diode (a first rectification element) D1 and a cathode of the other diode (a second rectification element) D4 may be connected to the other end of an input winding of the transformer 703. In the rectification circuit 705, an anode of one diode D2 (a first rectification element) and a cathode of the other diode D3 (a second rectification element) may be connected to the other end of an output winding of the transformer 703. The rectification circuits 704, 705 may rectify AC currents input from the transformer 703 so as to output positive and negative currents.

The capacitors C1, C3 may smooth rectified positive currents to supply positive DC currents to the LED strings 706, 708, respectively. The capacitors C2, C4 may smooth rectified negative currents to supply negative DC currents to the LED strings 707, 709, respectively.

Each of the LED strings 706, 707, 708, 709 may be formed of twelve LEDs being connected in series. Anode sides of the LED strings (or, first LED strings) 706, 708 may be connected to connection nodes between diodes D1, D2 of the rectification circuits 704, 705 and the capacitors C1, C3, respectively. Cathode sides of the LED strings (or, second LED strings) 707, 709 may be connected to connection nodes between diodes D4, D3 of the rectification circuits 704, 705 and the capacitors C2, C4, respectively. Cathode sides of the LED strings 706, 708 and anode sides of the LED strings 707, 709 may be connected to a common ground.

In FIG. 8, there is illustrated the case where each of the LED strings 706, 707, 708, 709 is formed of twelve LEDs. However, the inventive concept is not limited thereto. For example, in an exemplary embodiment the number of LEDs in each LED string can be less or more than twelve. That is, the number of LEDs in each LED string can be changed according to a size of a liquid crystal display device.

In operation, a DC voltage $V_{IN}$ supplied from the DC power supply 701 may be converted into an AC voltage with a predetermined frequency and amplitude via the inverter 702, and the AC voltage may be supplied to one end of input and output windings of the transformer 703. The input and output windings of the transformer 703 may be driven by input AC voltages, respectively. The same AC currents may flow into input and output windings of the transformer 703.

The transformer 703 may output the same AC currents to the rectification circuits 704, 705 connected to the other ends of the input and output windings of the transformer 703, respectively. In the rectification circuits 704, 705, an AC current input from the transformer 703 may be rectified into positive and negative currents by diode pairs (D1, D4), (D2, D3), respectively. The capacitors C1, C2, C3, C4 may smooth positive and negative currents rectified by the rectification circuit 704, 705 to supply positive and negative DC currents to the LED string 706, 707, 708, 709. The same positive DC currents and the same negative DC currents may be supplied to the LED strings 706, 707, 708, 709, so that the LED strings 706, 707, 708, 709 are switched on.

With the above-described LED backlight device 700, since a circuit for driving the LED strings 706, 707, 708, 709 is implemented using one transformer 703, it is possible to simplify the circuit structure. Further, it is possible to supply a voltage necessary for driving the LED strings 706, 707, 708, 709 using one inverter 702. Since an output of a constant current circuit formed of the transformer 703, the rectification circuits 704, 705, and the capacitors C1, C2, C3, C4 is connected to anode and cathode sides of the LED strings 706, 707, 708, 709, the cathode and anode sides of the LED strings 706, 707, 708, 709 may be grounded. Therefore, it may be easy to connect the cathode and anode sides of the LED strings 706, 707, 708, 709 to a common ground, for example, a case of a liquid crystal display device. In other words, arrangement of a ground wiring need not be an implementation factor. In the LED backlight device 100 in FIG. 13A, each circuit needs to be connected to a ground terminal via a cable from a terminal for ground, independently. However, it is possible to simplify a structure associated with the ground wiring within a liquid crystal display device by applying the LED backlight device 700 in FIG. 8 to a liquid crystal display device. The LED backlight device 700 in FIG. 8 may be configured such that the same AC current flows into input and output windings of the transformer 703. In this case, although forward voltages of the LED strings 706, 707, 708, 709 are different, the same current may be supplied to the LED strings 706, 707, 708, 709.

A circuit structure for simulating the operation of the LED backlight device 700 in FIG. 8 will be described with reference to FIG. 9. A simulation circuit 800 in FIG. 9 may be configured by replacing an inverter 702 of the LED backlight device 700 in FIG. 8 with an AC power supply 802 and LED strings 706, 707, 708, 709 with resistive loads R1, R2, R3, R5.

Figure 9:
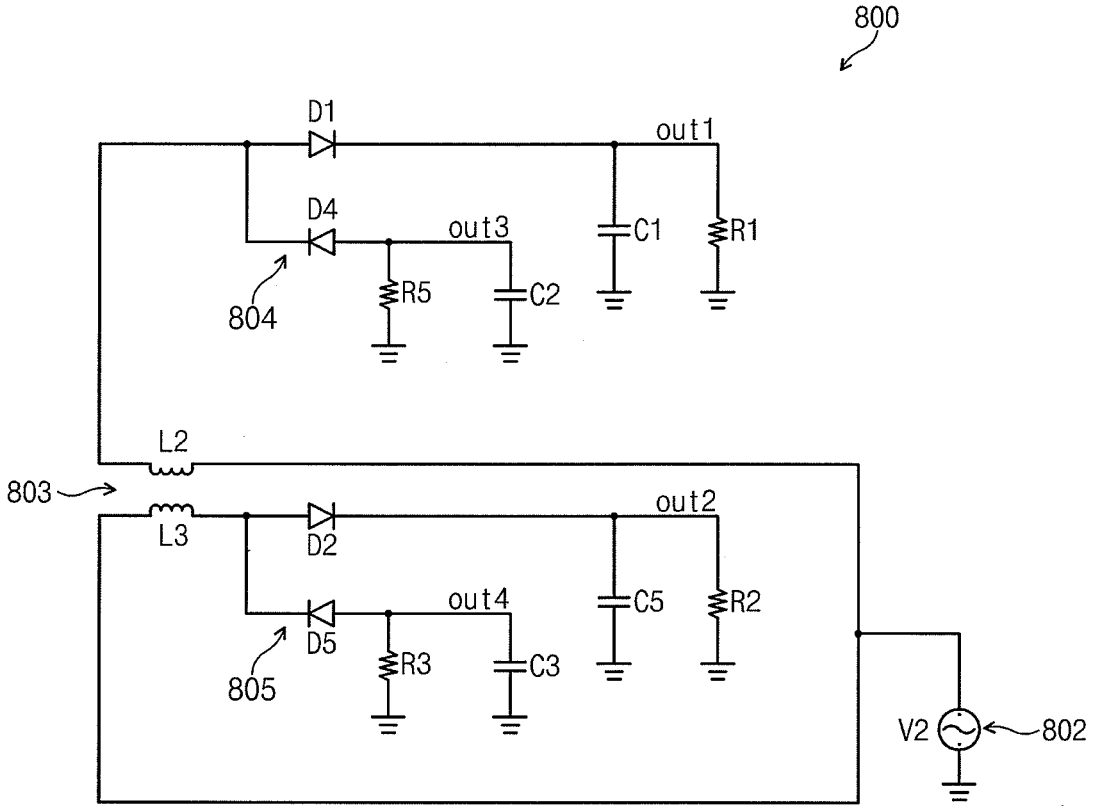
FIG. 9 is a diagram schematically illustrating a circuit structure for simulating the operation of the LED backlight device of FIG. 8.

Referring to FIG. 9, the simulation circuit 800 may include an AC power supply 802 as an inverter, a transformer 803, rectification circuits 804 and 805, resistive loads R1, R2, R3, R5 as LED strings, and capacitors C1, C2, C3, C5.

The AC power supply 802 may supply an AC voltage V2 with a predetermined frequency and amplitude to one end of input and output windings of the transformer 803. The transformer 803 may have the same turn ratio as a transformer 703 in FIG. 8. The transformer 803 may output the same AC currents to the rectification circuits 804, 805 using an input AC voltage V2. Each of the rectification circuits 804 and 805 may be formed of diode pairs (D1, D4), (D2, D5), respectively. The rectification circuits 804, 805 may rectify the AC currents input from the transformer 803 into positive and negative currents. The capacitors C1, C2, C3, C5 may smooth rectified positive and negative currents so as to be provided to the resistive loads R1, R2, R3, R5 as positive and negative DC currents.

Figure 10A:
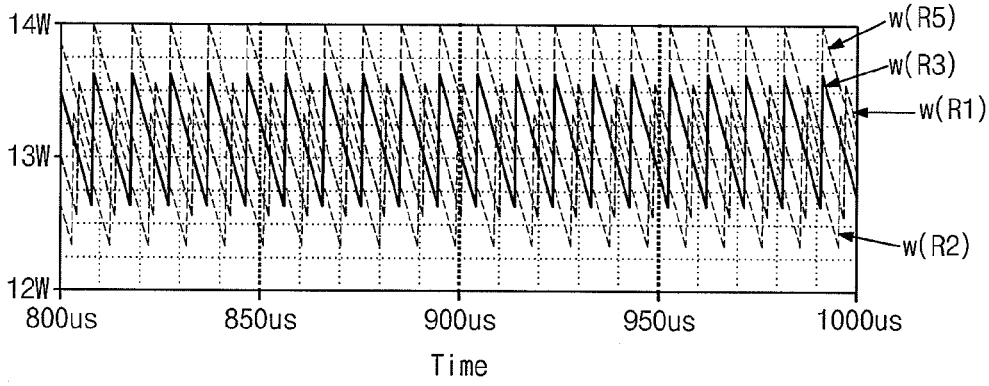
FIGS. 10A, 10B and 10C are diagram showing signals of respective components within the LED backlight device of FIG. 9.

The operation of the simulation circuit 800 will now be described with reference to FIGS. 10A through 10C which show signals of respective components within the LED backlight device 700. FIG. 10A shows power losses w(R1), w(R2) w(R3), w(R5) of resistive loads R1, R2, R3, R5, FIG. 10B shows currents –i(1*l*), –i(R2), i(R3), i(R5) flowing via the resistive loads R1, R2, R3, R5 simulating LED strings, and FIG. 10C shows output voltages v(out1), v(out2), v(out3), –v(out4) of rectification circuits 804, 805.

At a simulation operation of the LED backlight device 700, a difference between forward voltages of LED strings may be considered. An AC power supply 802 may supply an AC voltage to input and output windings of a transformer 803.

Figure 10B:
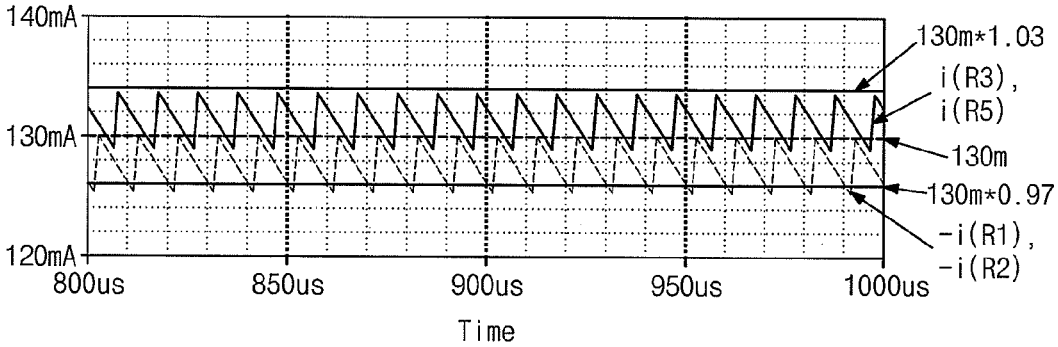
Figure 10C:
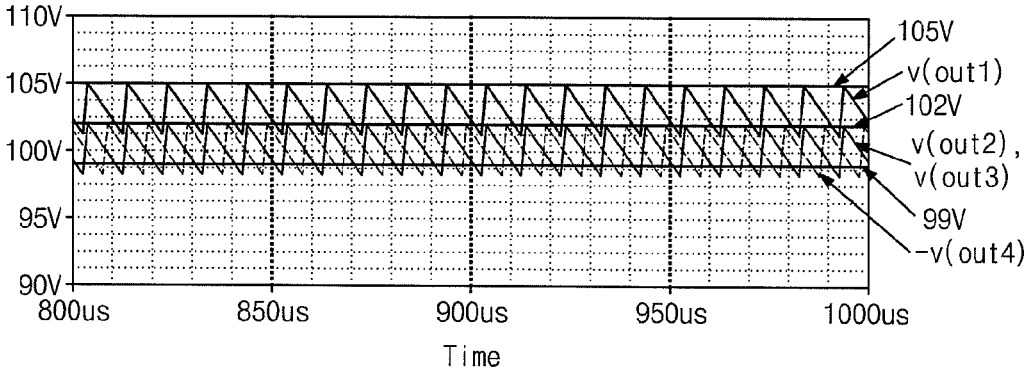

In FIGS. 10A through 10C, the horizontal axis indicates a measurement time, and there are represented variations of signals during a period from 800 μs to 1000 μs.

In FIG. 9, the AC power supply 802 as an inverter may generate a sinusoidal wave AC voltage having amplitude of 110V. The transformer 803 may be alternately driven by the sinusoidal wave AC voltage, and positive and negative currents may be rectified by applying the same AC current to rectification circuits 804, 805. The rectified positive and negative currents may be smoothed by capacitors C1, C2, C3, C5 such that positive and negative DC currents are supplied to resistive loads R1, R2, R3, R5 simulating LED strings. At this time, currents flowing via the resistive loads R1, R2, R3, R5 may be as illustrated in FIG. 10B.

In the simulation circuit 800 of FIG. 9, the resistive loads R1, R2, R3, R5 simulating LED strings may be set to have different power losses to simulate a difference between forward voltages. As illustrated in FIG. 10A, a power loss w(R5) of the resistive load R5 may be about 13.5 W as a maximum value, power losses w(R1), w(R3) of the resistive loads R1, R3 may be about 13.2 W as a standard value, and a power loss w(R2) of the resistive load R2 may be about 12.7 W as a minimum value.

Positive and negative currents output from the rectification circuits 804, 805 may be smoothed by capacitors C1, C2, C3, C5 so as to be supplied to the resistive loads R1, R2, R3, R5 simulating LED strings. At this time, currents –i(R1), –i(R2), i(R3) and i(R5) flowing via the resistive loads R1, R2, R3 and R5 may be converged to 130 mA as illustrated in FIG. 10B.

In the simulation circuit 800 for simulating an operation of an LED backlight device 700 in FIG. 8, the resistive loads R1, R2, R3 and R5 simulating LED strings may be set to have different power losses for simulation of a forward voltage difference. In this case, currents flowing via the resistive loads R1, R2, R3 and R5 may be constant.

With the simulation operation of the LED backlight device 700 using the simulation circuit 800, currents –i(R1), –i(R2), i(R3) and i(R5) flowing via the resistive loads R1, R2, R3, R5 simulating LED strings may be constant by outputting the same AC currents to the rectification circuits 804, 805 from the transformer 803 driven by the AC power supply 802.

Figure 11:
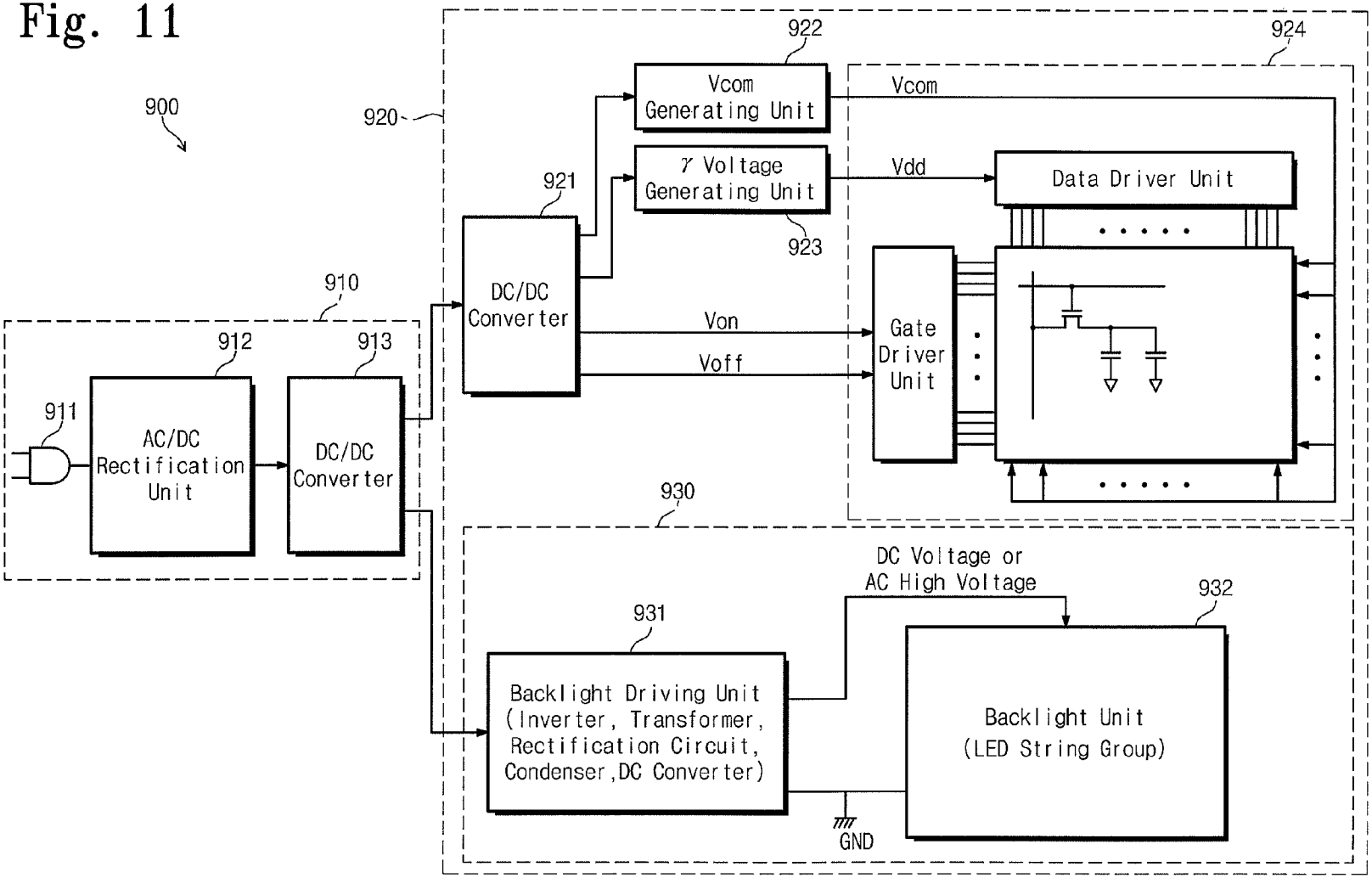
FIG. 11 is a block diagram schematically illustrating a liquid crystal display device including one of the LED backlight devices of FIGS. 2 and 5.

FIG. 11 is a block diagram schematically illustrating a liquid crystal display device including one of the exemplary embodiments of LED backlight devices in FIGS. 2 and 5. Referring to FIG. 11, a liquid crystal display device 900 may include an AC/DC power supply device 910, an LCD module block 920, and a backlight device 930.

The AC/DC power supply device 910 may be formed of an outlet 911, an AC/DC rectification unit 912, and a DC/DC converter 913. The AC/DC power supply device 910 may convert a common AC power supply voltage 100V or 240V into a DC power supply voltage, and the DC power supply voltage may be output to the LCD module block 920.

The LCD module block 920 may include a DC/DC converter 921, a common electrode voltage (Vcom) generating unit 922, a gamma(y) voltage generating unit 923, an LCD panel unit 930, and a backlight device 930. The LCD module block 920 may display images in response to image data provided from an external graphic controller (not shown). The LCD panel unit 924 may include a gate driver unit, a data driver unit, a plurality of data lines connected to the data driver unit, a plurality of gate lines connected to the gate driver unit, and a plurality of liquid crystal elements arranged at intersections of the gate lines and the data lines. The liquid crystal elements may be divided based upon display image regions, and gray scales of the display image regions may be controlled independently.

The common electrode voltage generating unit 922 may generate a common electrode voltage Vcom based upon a DC voltage converted by the DC/DC converter 921. The common electrode voltage Vcom may be supplied to the LCD panel unit 924.

The gamma voltage generating unit 923 may generate a gamma voltage Vdd based upon the DC voltage converted by the DC/DC converter 921. The gamma voltage Vdd may be supplied to the LCD panel unit 924. In FIG. 11, there is illustrated the case where the common electrode voltage generating unit 922 and the gamma voltage generating unit 923 are separated from the LCD panel unit 924. However, the inventive concept is not limited thereto. For example, in an exemplary embodiment the LCD panel unit 924 can be formed to include the common electrode voltage generating unit 922 and the gamma voltage generating unit 923.

The backlight device 930 may include a backlight driving unit 931 and a backlight unit 932. The backlight driving unit 931 may include an inverter 302, transformers 303, 304, 305, full-wave rectification circuits 306, 307, 308, and a DC converter 312 which are illustrated in FIG. 2. Alternatively, the backlight driving unit 931 may include an inverter 502, transformers 503, 504, 505, rectification circuits 506, 507, 508, and capacitors C1, C2, C3, C4, C5, C6 which are illustrated in FIG. 5. The backlight unit 932 may include a plurality of LED strings 309, 310, 311 illustrated in FIG. 2 or a plurality of LED strings 509, 510, 511, 512, 513, 514 illustrated in FIG. 5. When an input image is displayed by the LCD panel unit 924, the backlight unit 932 controls gray scale by adjusting luminance of the input image. Thus, a switch-on time may be controlled. The backlight driving unit 931 and the backlight unit 932 may be connected to a common ground GND, which can be coupled with a case of a container 1080 in FIG. 12.

Since the backlight driving unit 931 may be formed of an inverter 302, transformers 303, 304, 305, full-wave rectification circuits 306, 307, 308, and a DC converter 312 illustrated in FIG. 2 or the backlight driving unit 931 is formed of an inverter 502, transformers 503, 504, 505, rectification circuits 506, 507, 508, and capacitors C1, C2, C3, C4, C5, C6 illustrated in FIG. 5, power consumed by the backlight device 930 may be reduced. The LCD module block 920 can be implemented to include the AC/DC power supply device 910.

Figure 12:
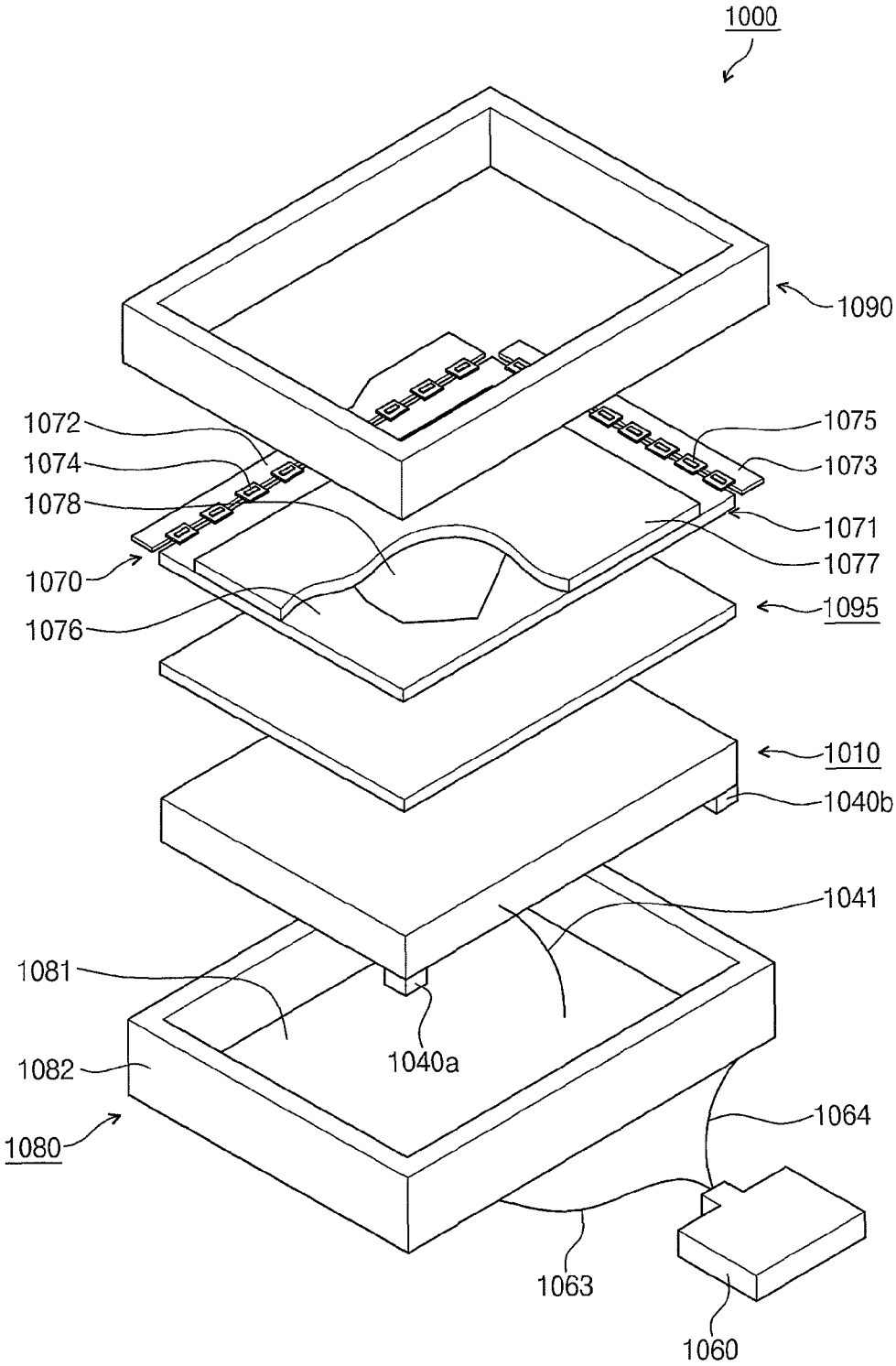
FIG. 12 is an exploded perspective view of a liquid crystal display device according to an exemplary embodiment of the inventive concept.

FIG. 12 is an exploded perspective view of a liquid crystal display device according to an exemplary embodiment of the inventive concept. FIG. 12 shows the equipment, not a circuit structure of a liquid crystal display device.

Referring to FIG. 12, a liquid crystal display device 1000 may include a backlight assembly 1010, a display unit 1070, and a container 1080.

The display unit 1070 may include a liquid crystal display panel 1071 configured to display an image and data and gate printed circuits 1072, 1073 configured to output driving signals for driving the liquid crystal display panel 1071. The data printed circuit 1072 and the gate printed circuit 1703 may be electrically connected to the liquid crystal display panel 1071 via a data Tape Carrier Package (TCP) 1074 and a gate TCP 1075, respectively.

The liquid crystal display panel 1071 may include a Thin Film Transistor (TFT) substrate 1076, a color filter substrate 1077 mounted to be opposite to the TFT substrate 1076, and a liquid crystal 1078 interposed between the substrates 1076, 1077.

The TFT substrate 1076 may be a transparent glass substrate on which TFTs (not shown) being switching elements are formed in a matrix shape. Source and gate terminals of each TET may be connected to data and gate lines, respectively. A pixel electrode (not shown) made up of a transparent conductive substance may be formed at a drain terminal of each TET.

The color filter substrate 1077 may be a substrate on which red, green blue (RGB) color pixels (not shown) are formed by a thin film process. A common electrode (not shown) made up of a transparent conductive material may be formed at the color filter substrate 1077.

The container 1080 may be formed of a bottom surface 1081 and a side wall 1082 formed at an edge of the bottom surface 1081 so as to provide a space. The backlight assembly 1010 and the liquid crystal display panel 1071 may be fixed in place by the container 1080.

An area of the bottom surface 1081 may be determined to be sufficient to mount the backlight assembly (or, a backlight unit 932 in FIG. 11). The bottom surface 1081 may have such a structure as the backlight assembly 1010. In this embodiment, the bottom surface 1081 and the backlight assembly 1010 may have a square plate shape. The side wall 1082 may be vertically extended from an edge of the bottom substrate 1081 such that the backlight assembly 1010 does not protrude outside the container 1080.

In this embodiment, the liquid crystal display device 1000 may further comprise a backlight driving unit 1060 and a top chassis 1090.

The backlight driving unit 1060 may be disposed within the container 1080, and may generate a DC current/voltage for driving the backlight assembly 1010. The DC current/voltage generated from backlight driving unit 1060 may be supplied to the backlight assembly 1010 via a first power line 1063 and a second power line 1064. The first power line 1063 and the second power line 1064 may be connected to a first electrode 1040*a* and a second electrode 1040*b* formed at both sides of the backlight assembly 1010, respectively. The first power line 1063 and the second power line 1064 can be connected to the first electrode 1040*a* and the second electrode 1040*b* using a separate member (not shown), respectively. The backlight assembly 1010 may be grounded to the container 1080 by a ground wiring 1041. Like the backlight assembly 1010, the backlight driving unit 1060 may be grounded to the container 1080 by containing the backlight driving unit 1060 within the container 1080. That is, the backlight assembly 1010 and the backlight driving unit 1060 may be grounded in common to the container 1080.

The top chassis 1090 may be coupled with the container 1080, with an edge of the liquid crystal display panel 1071 being surrounded thereby. The top chassis 1090 may be used to prevent the liquid crystal display panel 1071 from being broken by external impact and from leaving the container 1080.

The liquid crystal display device 1000 may further include an optical sheet 1095 to improve the light output from the backlight assembly 1010. The optical sheet 1095 may be formed of a diffusion sheet for diffusing a light or a prism sheet for focusing a light.

With the liquid crystal display device 1000 including an LED backlight device 300 or LED backlight device 500, since the backlight driving unit 1060 is formed of an inverter 302, transformers 303, 304, 305, full-wave rectification circuits 306, 307, 308, and a DC converter 312 illustrated in FIG. 2 or is formed of an inverter 502, transformers 503, 504, 505, rectification circuits 506, 507, 508, and capacitors C1, C2, C3, C4, C5, C6 illustrated in FIG. 5, power consumed by an LED backlight device may be reduced. Alternatively, the liquid crystal display device 1000 may include LED backlight devices 200 and 700 illustrated in FIGS. 1 and 8, respectively.

LED backlight devices according to the exemplary embodiments of the inventive concept may be suitable for a relatively large-sized liquid crystal panel.

The above-disclosed subject matter is to be considered illustrative, and not restrictive, and the appended claims are intended to cover the disclosed embodiments and any modifications, enhancements, and other embodiments, which fall within the true spirit and scope of the inventive concept.

What is claimed is:

1. An LED backlight device comprising:

an inverter having an input connected to a DC power supply and configured to output an AC current;

a plurality of transformers each configured to drop the AC current input from the inverter, input sides of the transformers being connected in series with respect to an output of the inverter and output sides of the transformers being disposed in parallel;

a plurality of full-wave rectification circuits respectively connected to the output sides of the transformers, and configured to full-wave rectify the dropped AC currents, respectively;

a plurality of smoothing circuits respectively connected to outputs of the plurality of full-wave rectification circuits, and configured to smooth the full-wave rectified currents to output DC currents, respectively; and a plurality of LED strings respectively connected to outputs of the smoothing circuits and each of the LED strings having a plurality of LEDs connected in series cathode to anode respectively, wherein respective turn ratios of the input and output sides of the transformers are the same as one another.

2. The LED backlight device of claim 1, wherein each of the full-wave rectification circuits comprises a diode bridge circuit, and cathode sides of the LED strings and anode sides of the full-wave rectification circuits are connected to a common ground, one end of the serially connected input sides of the transformers being connected to the common ground and the other end of the serially connected input sides of the transformers being connected to the output of the inverter.

3. The LED backlight device of claim 1, wherein inductance values of the output sides of the transformers are set to be larger than impedance values of the LED strings.

4. The LED backlight device of claim 1, further comprising: a DC converter having an input connected to the DC power supply and an output connected to a common node of the full-wave rectification circuits and configured to output a DC voltage for compensating for a voltage corresponding to a difference between forward voltages of the LED strings.

5. The LED backlight device of claim 4, wherein the DC converter is further configured to set the DC voltage to a maximum voltage by which the LED strings are not switched on.

6. The LED backlight device of claim 4, wherein each of the full-wave rectification circuits comprises a diode bridge circuit, and cathode sides of the LED strings and anode sides of the full-wave rectification circuits are connected to a common ground, one end of the serially connected input sides of the transformers being connected to the common ground and the other end of the serially connected input sides of the transformers being connected to the output of the inverter.

7. An LED backlight device comprising:

an inverter having an input connected to a DC power supply and configured to output an AC voltage;

a plurality of transformers each configured to output AC currents, input windings of the transformers being connected in series to form a loop, output windings of transformers being disposed in parallel, and one end of the output windings of the transformers being connected in parallel to an output of the inverter;

a plurality of rectification circuits respectively connected to the other ends of the output windings of the transformers, and configured to rectify the AC currents from the transformers to output positive currents and negative currents, respectively;

a plurality of smoothing circuits respectively connected to outputs of the rectification circuits, and configured to smooth the positive and negative currents to output positive and negative DC currents, respectively; and a plurality of LED strings respectively connected to outputs of the smoothing circuits and each of the LED strings having a plurality of LEDs.

8. The LED backlight device of claim 7, wherein each of the rectification circuits includes a first rectification element configured to output a positive current and a second rectification element configured to output a negative current, and the LED strings includes first LED strings and second LED strings, anode sides of the first LED strings being connected to outputs of first rectification elements of the rectification circuits and the smoothing circuits, respectively, and cathode sides of the second LED strings being connected to outputs of second rectification elements of the rectification circuits and the smoothing circuits, respectively.

9. The LED backlight device of claim 8, wherein cathode sides of the first LED strings and anode sides of the second LED strings are connected to a common ground.

10. The LED backlight device of claim 7, wherein inductance values of the input windings of the transformers and inductance values of the output windings of the transformers are adjusted such that the same input AC currents flow into the input windings of the transformers and the same output AC currents flow into the output windings of the transformers.

11. An LED backlight device comprising:

an inverter having an input connected to a DC power supply and configured to output an AC voltage;

a transformer having an input winding and an output winding wound in a reverse direction and configured to output an AC current, one end of the input winding and one end of the output winding being connected in parallel to an output of the inverter;

a plurality of rectification circuits respectively connected to the other end of the input winding and the other end of the output winding, and configured to rectify AC currents output from the other end of the input winding and the other end of the output winding to output positive currents and negative currents, respectively;

a plurality of smoothing circuits respectively connected to outputs of the rectification circuits, and configured to smooth the positive and negative currents to output positive and negative DC currents, respectively; and a plurality of LED strings respectively connected to outputs of the smoothing circuits and each of the LED strings having a plurality of LEDs.

12. The LED backlight device of claim 11, wherein each of the rectification circuits includes a first rectification element outputting a positive current and a second rectification element outputting a negative current, and the LED strings includes first LED strings and second LED strings, anode sides of the first LED strings being connected to outputs of first rectification elements of the rectification circuits and the smoothing circuits, respectively, and cathode sides of the second LED strings being connected to outputs of second rectification elements of the rectification circuits and the smoothing circuits, respectively.

13. The LED backlight device of claim 12, wherein cathode sides of the first LED strings and anode sides of the second LED strings are connected to a common ground.

14. A backlight device for a liquid crystal display device, comprising:

a plurality of light emitting diode strings, each light emitting diode string comprising a series of diodes coupled in series, one end of each diode string coupled to ground;

an inverter configured to convert a DC voltage supplied from a DC power source into an AC voltage having a predetermined frequency and amplitude;

one or more transformers configured to receive the AC voltage;

a plurality of rectification circuits whose respective input sides are configured to receive an AC voltage from a respective transformer; and a plurality of capacitors, each capacitor coupled between a non-grounded end of a respective light emitting diode string and an output of a respective rectification circuit, wherein one end of a first light emitting diode string of a pair of light emitting diode strings has its anode coupled to ground and one end of a second light emitting diode string of the pair of light emitting diode strings has its cathode coupled to ground.

15. The backlight device of claim 14, wherein the rectification circuits comprise full-wave rectification circuits whose outputs are connected to respective non-grounded ends of the light emitting diode strings.

16. The backlight device of claim 14, wherein the rectification circuits comprise diode pairs, an anode of one of diode pairs being coupled to the non-grounded end of the first light emitting diode pair and a cathode of the second one of the diode pairs being coupled to the non-grounded end of the second light emitting diode string pair.

17. The backlight device of claim 14, wherein the DC power source is a DC power supply.

18. The backlight device of claim 14, wherein the DC power source comprises:

an AC/DC rectification unit configured to receive an AC power supply voltage from an AC outlet and to provide an input DC voltage; and a DC/DC converter configured to convert the input DC voltage from the AC/DC rectification unit into the DC voltage received by the inverter.

* * * * *